US006140638A

United States Patent [19]

Tanner et al.

[11] Patent Number: 6,140,638

[45] Date of Patent: Oct. 31, 2000

[54] BANDPASS REACTIVE COLLISION CELL

[75] Inventors: Scott D. Tanner, Aurora; Vladimir I. Baranov, Richmond Hill, both of Canada

[73] Assignee: MDS Inc., Concord, Canada

[21] Appl. No.: 09/086,461

[22] Filed: May 29, 1998

Related U.S. Application Data

[60] Provisional application No. 60/048,583, Jun. 4, 1997, and provisional application No. 60/074,831, Feb. 17, 1998.

[51] Int. Cl.[7] ..... H01J 49/42

[52] U.S. Cl. ..... 250/282; 250/292

[58] Field of Search ..... 250/282, 292, 250/288

[56] References Cited

U.S. PATENT DOCUMENTS

| | | | |
|---|---|---|---|
| 3,065,640 | 11/1962 | Langmuir et al. | 73/517 |
| 4,234,791 | 11/1980 | Engke et al. | 250/281 |
| 4,535,235 | 8/1985 | McIver, Jr. | 250/282 |
| 4,540,884 | 9/1985 | Stafford et al. | 250/282 |
| 4,963,736 | 10/1990 | Douglas et al. | 250/292 |
| 5,187,365 | 2/1993 | Kelley | 250/282 |
| 5,248,875 | 9/1993 | Douglas et al. | 250/282 |
| 5,767,512 | 6/1998 | Eiden et al. | 250/282 |
| 5,942,752 | 8/1999 | Wang | 250/288 |

FOREIGN PATENT DOCUMENTS

| | | | |
|---|---|---|---|
| 1307859 | 12/1988 | Canada | H01J 49/42 |
| 0 831 228 | 12/1997 | European Pat. Off. | H01J 49/10 |
| 2 299 446 | 3/1996 | United Kingdom | H01J 49/04 |
| 2 301 704 | 12/1996 | United Kingdom | H01J 49/34 |
| WO 93/09562 | 5/1993 | WIPO | H01J 49/42 |
| WO97/25737 | 7/1997 | WIPO | H01J 49/10 |

OTHER PUBLICATIONS

Grahams et al., "Mass spectrometry/mass spectrometry", Chemical and Engineering News, Nov. 30, 1981, pp. 40–52.

Gerlich, Dieter, "Inhomogeneous RF Fields: A Versatile Tool for the Study of Processes with Slow Ions", State–Selected and State–to–State Ion–Molecule Reaction Dynamics, Part 1: Experiment, Edited by Cheuk–Yiu Ng and Michael Baer, Advances in Chemical Physics Series, vol. LXXXII, 1992.

Douglas, D.J., "Some Current Perspectives on ICP–MS", Canadian Journal of Spectroscopy, vol. 34, No.2, 1989.

Rowan and Houk, "Attenuation of Polyatomic Ion Interferences in Inductively Coupled Plasma Mass Spectrometry by Gas–Phase Collisions", Applied Spectroscopy, vol. 43, No. 6, 1989.

Koppenaal et al, "Performance of an Inductively Coupled Plasma Source Ion Trap Mass Spectrometer", Journal of Analytical Atomic Spectrometry, Sep. 1994, vol. 9, (1053–1058).

(List continued on next page.)

*Primary Examiner*—Jack Berman
*Attorney, Agent, or Firm*—Bereskin & Parr

[57] ABSTRACT

A method of reducing isobaric interferences by transmitting ions from an ion source through an ion transmission device, typically a quadrupole collision cell, and then into an analyzing mass spectrometer, in which the collision cell is operated with a pass band which rejects intermediate ions which would otherwise tend to react to form isobaric interferences. Preferably ammonia is used as a reaction gas in the collision cell. Depending on the chemistry involved, the collision cell may be operated to set the low mass cutoff at an appropriate level, or more usually, the pass band will have both high and low mass cutoffs determined by applying both RF and DC to the collision cell. The collision cell may also be operated with a pass band to transmit ions into a time-of-flight (TOF) mass spectrometer, thus limiting the mass range of ions entering the TOF and thereby improving the duty cycle of the TOF.

60 Claims, 24 Drawing Sheets

OTHER PUBLICATIONS

Eiden et al, "Selective Removal of Plasma Matrix Ions in Plasma Source Mass Spectrometry", Journal of Analytical Atomic Spectrometry, Apr. 1996, vol. 11 (317–322).

Ervin & Armentrout, "Translational energy dependence of . . . ", J. Chem. Phys. 83(1), Jul. 1, 1985.

Turner et al, "Interface Studies in the ICP–Mass Spectrometer", Plasma Source Mass Spectrometry: Developments and Applications, undated.

Douglas & French, "Collisional Focusing Effects in Radio Frequency Quadrupoles", J. Am.Soc. Mass Spectrom. 1992, 3, 398–408.

Barinaga & Koppenaal, "Ion–trap Mass Spectrometry with an Inductively Coupled Plasma Source", paper presented in part at the 41st ASMS Conference on Mass Spectrometry and Allied Topics, May 30–Jun. 4, 1993, San Francisco, CA.

Eiden et al, "Beneficial Ion/Molecule Reactions in Elemental Mass Spectrometry", presented in part at the Asilmor Conference on Mass Spectrometry), Sep. 1996 and 23rd Annual FACSS meeting, Kansas City, MO, Sep. 1996.

Douglas, D.J., "Applications of Collision Dynamics in Quadrupole Mass Spectrometry", J. Am. Soc. Mass Spectrom. 1998, 9, 101–113.

Authors: Watson, J. T., Jaouen, D., Mestdagh, H. and Rolando, C. International Journal of Mass Spectrometry and Ion Processes, 93 (1989) 225–235, Elsevier Science Publishers B.V., Amsterdam—Printed in the Netherlands "A Technique for Mass Selective Ion Rejection in a Quadrupole Reaction Chamber".

BANDPASS REACTIVE COLLISION CELL

RELATED APPLICATION

This invention claims the benefit of provisional application Ser. No. 60/048,583 filed Jun. 4, 1997 and 60/074,831 filed Feb. 17, 1998 entitled "Bandpass Reactive Collision Cell".

FIELD OF THE INVENTION

This invention relates to method and apparatus for resolving ion signals for an analyte from ion signals caused by isobaric and non-spectral interferences. More broadly, it relates to transmitting ions having m/z values in a pass band, through a device such as a collision cell, for subsequent analysis.

BACKGROUND OF THE INVENTION

In mass spectrometry, it is common to have analyte ions of interest obscured or interfered with by ions which have the same nominal mass-to-charge (m/z) value, or by ions that have an m/z value which cannot be resolved from that of the analyte ion by the mass spectrometer being used. These are called isobaric or spectral interferences. Such interferences are common in many types of mass spectrometers, including for example those which use a plasma ion source, those which use glow discharge ion sources, and those which use electrospray and ion spray sources.

Isobaric or spectral background interferences may typically arise from the plasma itself, typical interfering ions being $Ar^+$, $ArO^+$, $Ar_2^+$, $ArCl^+$, $ArH^+$, $ClO^+$, and $MAr^+$ (where M is a sample matrix element, i.e. a dominant species of ion in the collection of ions), $MO^+$, and the like. Such interfering ions may also form in the extraction process (possibly due in part to the cooling of the plasma during expansion into vacuum, or due to interaction with the sampler or skimmer orifices), or within the momentum boundaries which exist at the edges of the sampler or skimmer.

Fragmentation of polyatomic ions in the collision cell can give rise to further or enhanced isobaric (spectral) interferences. Reaction of plasma ions with the collision gas used in a multipole device or collision cell may also give rise to spectral background interference, as can ionization of contaminant species derived from the collision cell or vacuum chamber or from contaminants in the collision gas.

It has commonly been thought that one solution to the isobaric interference problem is to use a high mass resolution mass analyzer, but this approach has not been particularly successful and is also hampered by the accompanying loss of ion signal which is inherent in the high resolution approach.

In mass analysis, non-spectral interferences are also commonly encountered. These typically derive from neutral metastable species, and produce an elevated continuum background, i.e. a background which is elevated over a range of masses (so that it is non-spectral). This background adversely affects the detection limit of the instrument.

Therefore, it is an object of the invention in one aspect to provide a method of reducing isobaric and non-spectral interferences in an efficient manner, with reduced ion signal loss, and if desired in addition with relatively high resolution.

BRIEF SUMMARY OF THE INVENTION

Accordingly, the invention in one of its aspects provides a method of operating a mass spectrometer system including an ion transmission device, the method comprising:

(i) providing a reactive gas in the ion transmission device, whereby the ion transmission device functions as a reactive collision cell;

(ii) supplying a stream of sample ions to the reactive collision cell including desired ions to be selected and unwanted precursor ions which may react with the reaction gas to cause the formation of ions or metastables which may result, directly or indirectly through intermediate ions, in unwanted isobaric or non-spectral interferences;

(iii) determining a range of mass-to-charge ratios of at least some of the precursor ions and intermediate ions which could result in unwanted interferences; and (iv) applying an appropriate field to the reactive collision cell to establish a bandpass within the reactive collision cell covering a continuous range of mass-to-charge ratios including that of said desired ions and excluding the determined range of mass-to-charge ratios of at least some of the precursor and intermediate ions.

In another aspect, the invention provides a mass spectrometer system comprising:

(i) an ion source for producing sample ions;

(ii) a reactive collision cell having an entrance for receiving said sample ions, said sample ions including desired ions to be selected and unwanted precursor ions which may react with a reaction gas to cause the formation of ions or metastables which may result, directly or indirectly through intermediate ions, in unwanted isobaric or non-spectral interferences;

(iii) means for providing the reaction gas to said reactive collision cell; and (iv) means for applying a field to the reactive collision cell to establish a bandpass, and for adjusting the field to select a desired bandpass range, whereby in use, said desired ions are transmitted through the reactive collision cell, and at least some of said precursor and intermediate ions, which may result in unwanted isobaric or non-spectral interferences, are ejected.

Further objects and advantages of the invention will appear from the following description, taken together with the accompanying drawings.

DETAILED DESCRIPTION OF PREFERRED EMBODIMENTS

Figure 1:
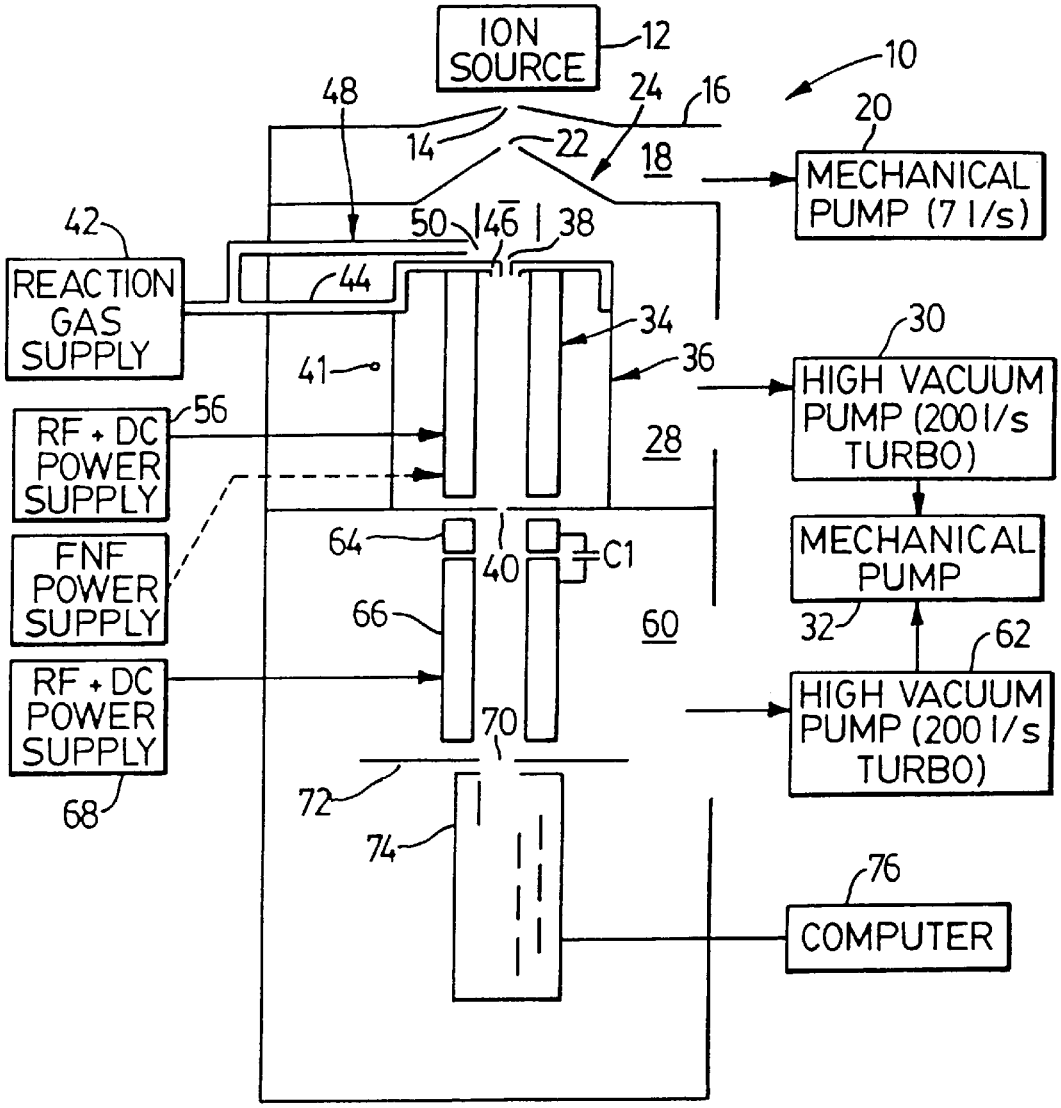
FIG. 1 is a diagrammatic view of mass analyzing apparatus according to the invention.

Reference is first made to FIG. 1, which shows diagrammatically a mass spectrometer system 10 according to the invention. The mass spectrometer system 10 includes an ion source 12, which will typically be a conventional inductively coupled plasma source, glow discharge source, or any other type of well-known ion source. The ion source 12, which typically (but not necessarily) operates at atmospheric pressure, injects a stream of ions through an orifice 14 in a sampler plate 16, into a first vacuum chamber 18 evacuated by a mechanical pump 20 to a pressure of e.g. 3 torr. The ions continue through an orifice 22 in a skimmer plate 24, through any desired conventional ion optics 26 in a second vacuum chamber 28 pumped by a turbo pump 30 (which is backed by a mechanical pump 32) to a pressure of e.g. 1 millitorr, and into a multipole device 34. Multipole device 34 is typically a quadrupole (thus having four rods), but may be an octopole, a hexapole, or another form of multipole.

Quadrupole 34 is contained in a "can" 36 having entrance and exit apertures 38, 40 for ions to enter and leave quadrupole 34. The combination of the quadrupole 34 and can 36 form what may be referred to as a collision cell 41. Reactive collision gas is supplied to the interior of can 36 from supply 42. As shown, collision gas from supply 42 flows through a conduit 44 and out through an annular opening 46 surrounding orifice 38, to act as a form of curtain and thus to reduce or prevent gas from the source 12 from entering can 36. A secondary conduit 48 from supply 42 terminates at a position 50 just in front of the orifice 38, so that reactive collision gas is directed into the ion stream before it enters quadrupole 34, for a purpose to be described. Position 50 can in fact be any position upstream of the orifice 38, and downstream of the ion source 12.

Quadrupole 34 may be operated as an RF-only device, i.e. as an ion transmission device, which is a low mass cutoff bandpass device, but low level DC may also be applied thereto (as will be described). These voltages are supplied from power supply 56.

Ions from quadrupole 34 passing through orifice 40 enter a third vacuum chamber 60 pumped by a high vacuum turbo pump 62 which may also be backed by mechanical pump 32. These ions travel through a prefilter 64 (typically an RF-only short set of quadrupole rods) into a mass analyzer 66 (which is typically a quadrupole but may also be a different type of mass analyzer such as a time-of-flight mass spectrometer, a sector instrument, an ion trap, etc.). Quadrupole 66 has RF and DC applied to its rods from power supply 68 in a conventional manner. Typically prefilter 64 is capacitively coupled to quadrupole 66 by capacitors C1, as is conventional, thus eliminating the need for a separate power supply for prefilter 64.

From quadrupole 66, ions travel through orifice 70 in an interface plate 72 and into a detector 74, where the ion signal is detected and passed to a computer 76 for analysis and display.

Figure 1A:
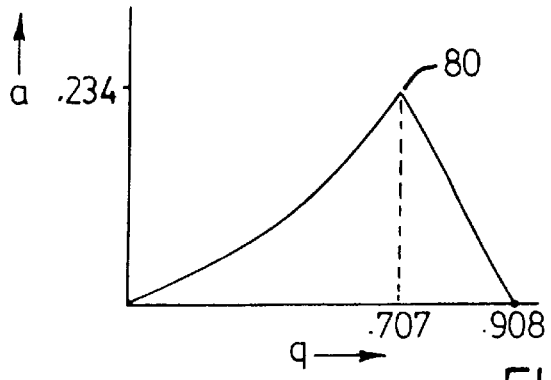
FIG. 1A is a conventional stability diagram for a quadrupole mass spectrometer.

FIG. 1A shows the standard a/q stability diagram for a conventional quadrupole mass spectrometer. The parameters a and q are plotted on the vertical and horizontal axes respectively, where $$a = \frac{4eU}{r_0^2\Omega^2 m}$$

$$q = \frac{2eV}{r_0^2\Omega^2 m}$$

where e is the electronic charge, U is the DC voltage applied to the rods, V is the peak to peak RF voltage applied to the rods, $r_0$ is the radius of the inscribed circle between the rods, Ω is the angular frequency (radians per second) of the RF voltage, and m is the mass of the ion.

Often, these equations are given in standard references with different constant multiplication factors, namely 8 instead of 4 for equation a and 4 instead of 2 for equation q. The multipliers 8 and 4 are used when the DC amplitude, U, is defined as the DC voltage applied to a single pair of rods and the voltage is defined relative to the pole bias offset, and the RF amplitude, V, is defined as the amplitude of the RF applied to a single pair of rods and is measured from the peak to ground (i.e. the half wave form). Ions which have a and q values outside the limits of stability as shown in the a/q diagram increase their amplitude of oscillation and are lost to the rods.

When a quadrupole mass spectrometer is operated in a normal resolving mode, with both AC and DC applied, as is the case for mass spectrometer 66, the operating line of the mass spectrometer normally passes through the tip 80 of the stability diagram, where q=0.707 and a=0.234. As the RF and DC amplitudes are scanned upwardly, ions of successively increasing mass pass through the tip 80 and are transmitted, while other ions are rejected.

When the mass spectrometer is operated as an RF-only quadrupole or ion transmission device, no DC is applied and the quadrupole operates on the q axis (a=0). Ions of mass corresponding to $q \leqq 0.908$ (which occurs at point 82 on the q axis) are transmitted, while ions of lower mass are rejected to the rods and are therefore not transmitted. A similar mode of operation may be defined for higher multipoles, but the stability region is less well defined.

Figure 2:
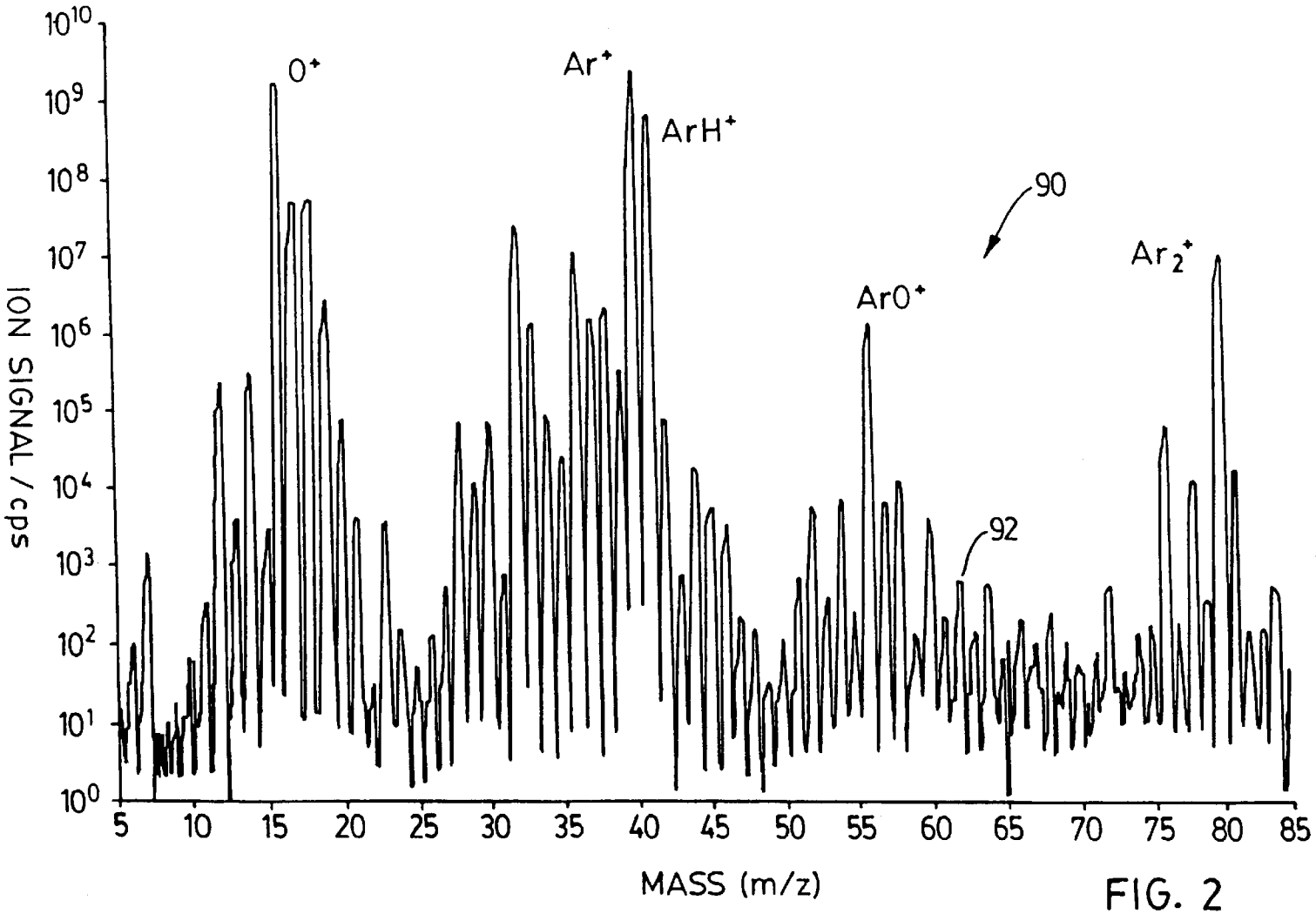
FIG. 2 shows a typical mass spectrum with interferences present.

Reference is next made to FIG. 2, which shows a conventional mass spectrum 90 obtained by use of a conventional mass spectrometer system (without collision cell 41), and with a plasma source. The sample used was 0.1% $HNO_3$. It will be seen that the background, indicated at 92, is relatively low. However the dominant ion signals at m/z 40, 41, 56 and 80 are due to the plasma ions $Ar^+$, $ArH^+$, $ArO^+$ and $Ar_2^+$ respectively. These signals interfere with (and in fact totally obscure) the signals which could be present from Ca, K, Fe, and Se.

Figure 3:
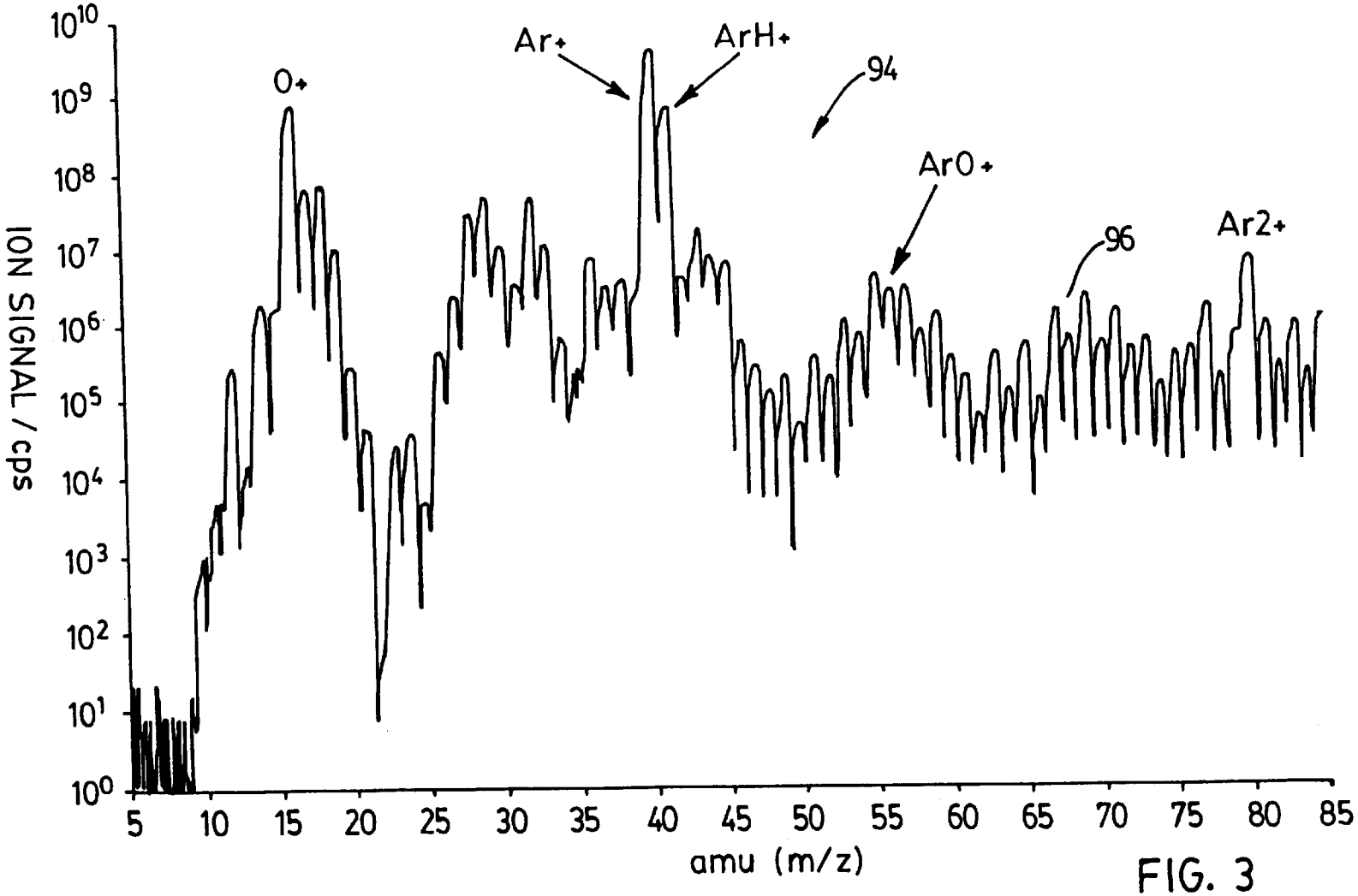
FIG. 3 shows another typical spectrum with mass interferences and with background noise.

Reference is next made to FIG. 3, which shows a mass spectrum 94 obtained using the apparatus of FIG. 1, but with the quadrupole or collision cell 34 pressurized only with plasma gas which has penetrated into the cell. The cell pressure (i.e. the pressure inside can 36) was believed to be of the order of 1 millitorr. RF-only was applied to the collision cell by capacitive coupling to the resolving mass spectrometer 66. A sample was used containing 10 parts per billion (ppb) Mg, Sc, Cu and Ge, as well as other analyte species having m/z values outside the range of the mass spectrum shown. The system was operated under normal analytical conditions (with RF and DC applied to quadrupole 66). The interferences at m/z 40, 41, 56 and 80 are due primarily to the plasma ions noted in connection with FIG. 2. The very large chemical background noise 96 which was present obscures most other masses and was due to ionization of background gas and contaminants within the collision cell.

Figure 4:
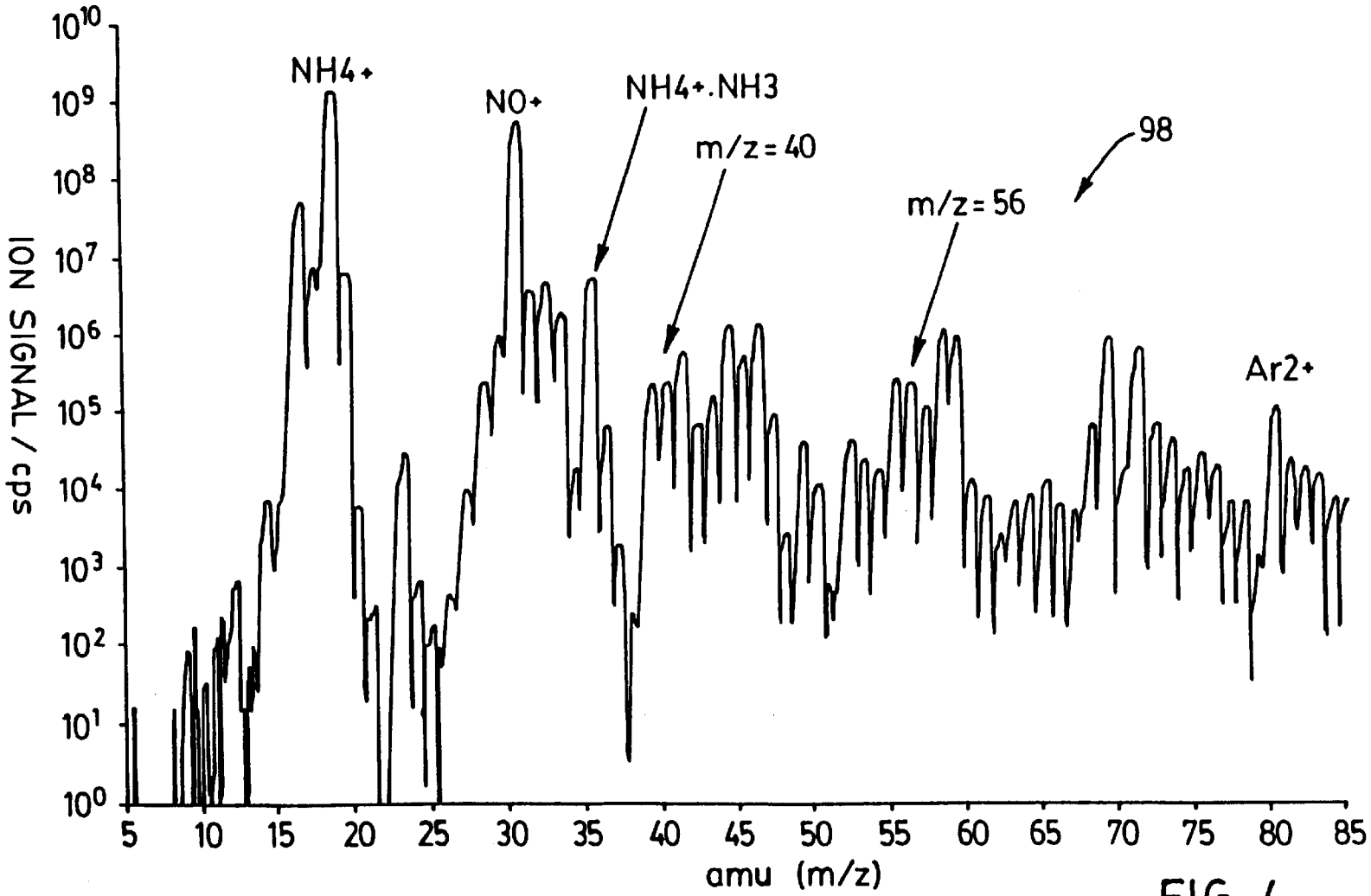
FIG. 4 shows a mass spectrum obtained using a feature of the invention.

Reference is next made to FIG. 4, which shows a mass spectrum 98 obtained using the same sample as in FIG. 3, but with a reactive collision gas, specifically ammonia ($NH_3$), added to the collision cell in the manner described in connection with FIG. 1 (i.e. the reactive collision gas was added to the interior of the cell through conduit 44 and also at point 50 in front of the cell). The presence of the reactive collision gas dramatically reduce the ion signals for $Ar^+$, $ArH^+$, and $ArO^+$, due to transformation of these ions by reaction with the reactive collision gas. However new interferences were seen from the ions $NH_4^+$, $NO^+$, $NH_4^+$ $NH_3$, and in addition significant levels of background interference were observed at most masses, interfering with trace elemental analysis.

Figure 5:
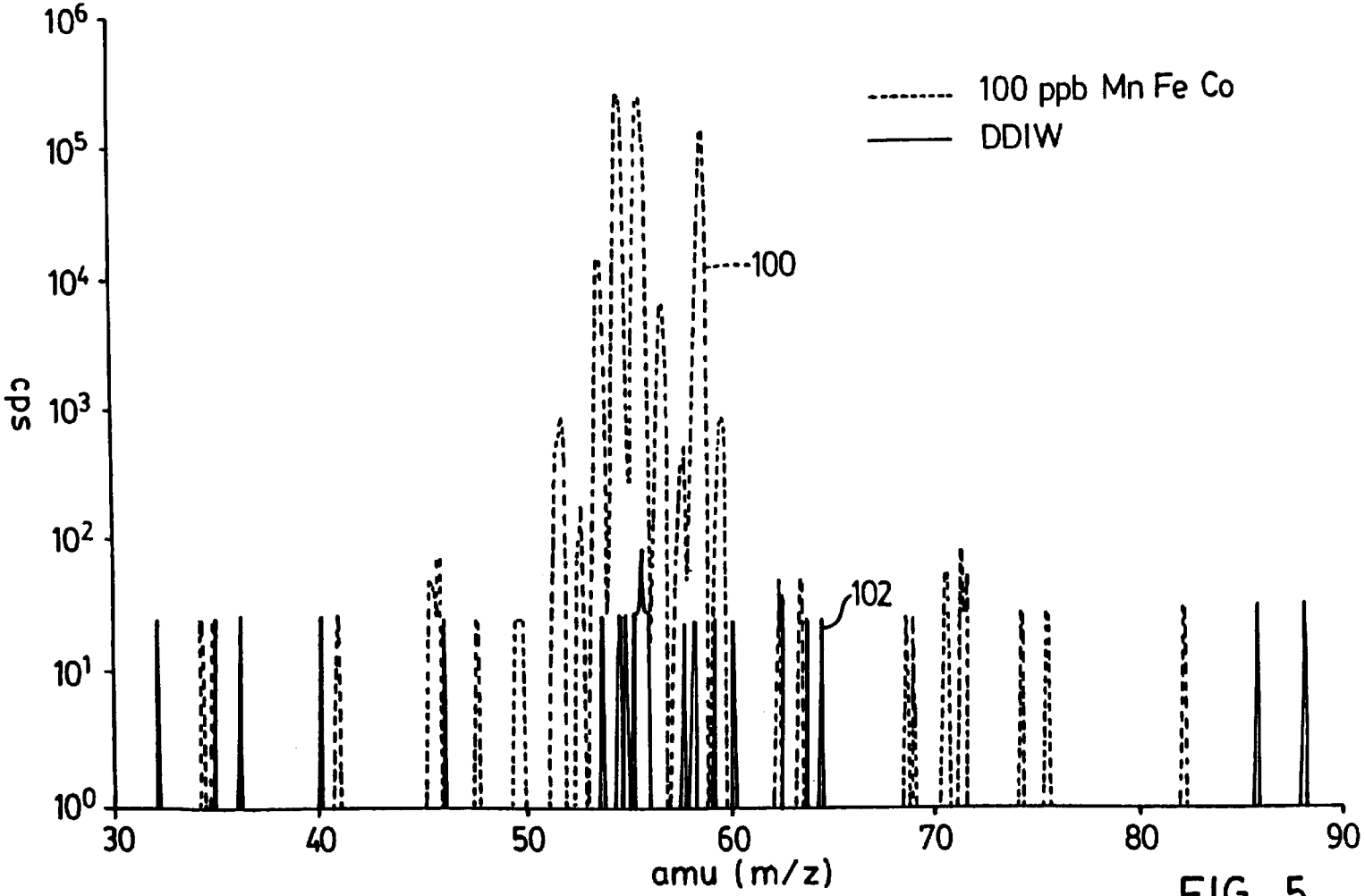
FIG. 5 shows two mass spectra obtained using features of the invention.

Reference is next made to FIG. 5, which shows two mass spectra 100, 102 obtained exactly as in the case of FIG. 4, except for the sample used and except that a small resolving DC voltage (17.5 volts DC) was added to the collision cell 34. The upper spectrum 100 in FIG. 5 corresponds to a sample containing 100 ppb Mn, Fe and Co. The lower spectrum 102 was obtained for a sample of distilled deionized water (DDIW). The RF was supplied by power supply 56 at 1.5 MHz, 300 volts RF peak-to-peak (p-p). These RF and DC voltages yield q=0.671 and a=0.078 at m/z=56. Under these conditions of a and q, ions having m/z such that 45<m/z<163 are stable, under collisionless conditions.

It will be seen from FIG. 5 that while the analyte signal has been reduced by a factor of 4 or 5 as compared with FIG. 4, the background interferences have been reduced by $10^4$. It will thus be seen that the background interference signals (including both spectral and non-spectral interference) were virtually eliminated, allowing virtually uninterfered determination of Mn, Fe and Co.

It is believed that the reason why the spectrum was so improved in FIG. 5 as compared with FIG. 4 is that desired elements such as Mn, Fe and Co do not react with the collision gas ($NH_3$), but the intermediates of a sequence of reactions which might have produced interferences in the mass range of interest, have been rejected. For example, $NH_3$ reacts to form NH4$^+$. $NH_4^+$ is relatively stable (and hence is a "terminal" ion), but it is outside the "bandpass" region of the collision cell 41 (as will be described) so is rejected. $NH_3$ also reacts with argon ion to form $ArH^+$, which at mass 41 is close to the bandpass (45<m/z<163) of the collision cell, but $ArH^+$ reacts by proton transfer to form $NH_4^+$ (which is not a problem, as discussed above) and to form neutral argon which, since it is neutral, does not cause interferences.

In general, when a collision gas (which can include gas from the ion source, e.g. argon for a plasma source) is present in the collision cell 41, then when sample ions are introduced into the collision cell, some sample ions react with the collision gas to form new ions, and then the new ions may react with organic contaminants present to form further isobaric interferences. The sequences of reactions which can occur can be varied and complex and are not fully known. However when the collision cell 41 is operated to reject precursor or intermediate ions (i.e. any ions formed in the sequence of reactions) before the reaction sequence produces ions which form isobaric interferences at desired m/z values, then the performance of the system is greatly improved.

Figure 5A:
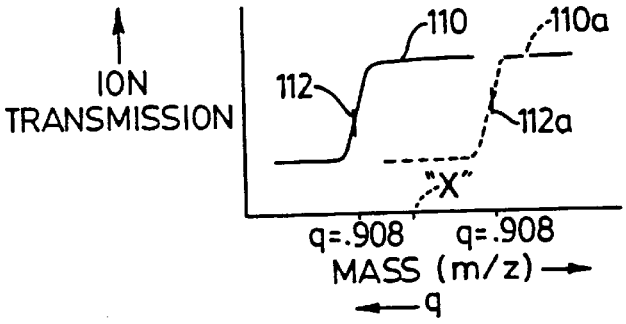
FIG. 5A is a plot showing ion transmission on the vertical axis, and m/z (and "q") on the horizontal axis.

By way of illustration, reference is made to FIG. 5A, which plots ion transmission on the vertical axis and mass on the horizontal axis. Since mass increases to the right on the horizontal axis, and since mass is inversely proportional to q, q increases to the left on the horizontal axis in FIG. 5A.

As is conventional, FIG. 5A shows curve 110, having a step 112 at q=0.908. It is assumed that the RF voltage amplitude V and frequency Ω are fixed for curve 110. Heavier masses, where $q \leqq 0.908$, are more stable and tend to be transmitted, while lighter masses, where q>0.908 (i.e. to the left of the step or cutoff 112) tend to be unstable and to be rejected. If an intermediate ion happens to have m/z value "x" in FIG. 5A, at q<0.908, then this ion can be rejected by shifting the low mass cut off to the right (to a higher mass), as shown by curve 110*a* and step 112*a*. This is accomplished by adjusting the RF voltage V or the RF frequency Ω, or both. This shifts the step 112*a* (where q=0.908), to a higher m/z value than "x", tending to reject the intermediate ions which would otherwise result in isobaric interferences. In effect, the collision cell 41 is operated with its rejection band (low masses whose q>0.908) encompassing intermediates of interfering ions, and with its pass band (heavier ions whose $q \leqq 0.908$) encompassing all other ions (up to the limit of its mass range).

If the intermediate ions to be rejected tend to occur both below and above the desired masses to be observed (as will commonly be the case), then as mentioned in connection with FIG. 5, resolving DC can be added to create the desired bandpass. This is shown for curve 120 in FIG. 5B, where ion transmission is plotted on the vertical axis, and m/z is plotted on the horizontal axis, increasing to the right, assuming fixed RF and DC voltage amplitudes and fixed RF frequency. (Since q and a are inversely proportional to m/z, q and a again increase to the left on the horizontal axis.)

Figure 5B:
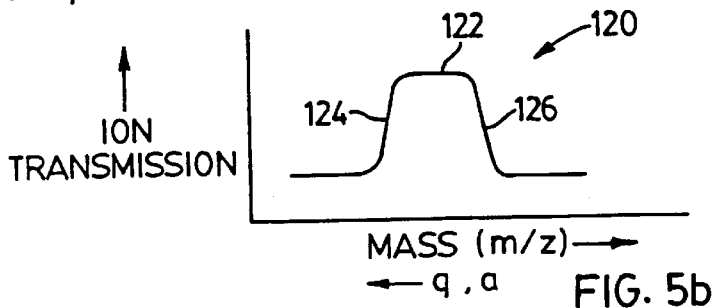
FIG. 5B is another plot showing ion transmission on the vertical axis, and m/z (and "q" and "a") on the horizontal axis.

In FIG. 5B, a bandpass region or peak 122 is shown. Ions of m/z values within the bandpass region 122 tend to be transmitted, while ions outside the bandpass region 122 tend to be rejected. The left hand side 124 of peak or region 122 is a low mass cutoff, while the right hand side 126 is now a high mass cutoff.

It will be understood with reference to FIG. 5B that ions which may react with other ions to form interferences, but which are outside the limits of the bandpass 122, are removed. Therefore, the sequence of reactions that would have caused interferences has been intercepted and blocked, while ions which are to be analyzed and which are in the desired window of m/z values, are transmitted for analysis.

While the spectrum in FIG. 5 has greatly reduced interferences, as compared with that of FIG. 4, for the reasons described, it is noted that the application of DC to the collision cell 41 can have the effect of creating losses, e.g. by causing ions to be scattered from the cell. The losses can be reduced by applying a lower voltage DC while maintaining the same q value. FIG. 6 shows two mass spectra 130, 132, obtained from the same samples as those of FIG. 5, but with the RF supplied at 1.2 MHz and 205 volts RF (peak-to-peak), and with the resolving DC reduced to 8 volts. These RF and DC values yield q=0.716 and a=0.056, defined at m/z=56. Under these conditions of q and a, ions having m/z such that 47<m/z<280 are stable under collisionless conditions. These conditions correspond to somewhat lower resolution (a larger pass band) in the collision cell 41 than those given in FIG. 5, but yield much more intense signals for the analyte ions (spectrum 130), together with perhaps somewhat higher interference ion signals.

It is noted that much of the spectrum 132 observed for the DDIW sample was derived from residual Mn, Fe and Co from the preceding sample, evidently due to insufficient washout, as can be observed from the ion signal ratios. In both FIG. 5 and FIG. 6, the high sensitivity of the method and apparatus used will be evident, since the main analyte samples contained only 100 ppb of analyte ions (Mn, Fe, Co), while the DDIW samples contained far less analyte.

It will be realized that in the method shown in connection with FIGS. 5A, 5B, the low mass end of the bandpass or ion transmission window is determined mainly by the RF amplitude and frequency applied to the collision cell 41, while the high mass end of the bandpass is defined primarily by the DC voltage applied. The purpose of course is not to obtain high resolution (and indeed high resolution would not normally be achievable at the pressures within the collision cell), but rather is to eliminate intermediates (precursors) of interference ions, before they can have an opportunity to create isobaric or similar interferences.

While ammonia has been shown as a preferred reaction gas (since it forms $NH_4^+$, which is relatively stable), other reaction gases may also be used, depending on the particular chemistry of the samples involved. In addition, the pressure within the collision cell can vary, again depending on the objective (which will depend in part on the chemistry involved). A preferred range of pressures is between 5 and 30 millitorr, but the pressure within the collision cell can vary in a range between 1 and 100 millitorr, or even a wider range, again depending on the particular chemistry and analyte involved.

The width of the bandpass window selected will also be chosen with respect to the chemistry involved in each particular case. The window bandwidth will depend on the masses of the desired ions to be observed, the type of collision cell used, and the masses of the interfering ions which could create isobaric interferences either themselves or by subsequent reactions. If the ions to be rejected are all of lower mass than those to be observed, then operation with RF-only, with the low mass cut off set appropriately, will be sufficient. If the ions to be rejected are of both lower and higher mass than those of the ions to be observed (as will more commonly be the case), then a bandpass window having low mass and high mass cutoffs is preferred.

While the bandpass window 122 described in connection with FIG. 5B has been indicated as being produced by conventional application of resolving RF and DC, the bandpass window 122 can be produced in various other ways. For example it can be produced by application of a filtered noise field to the collision cell, where the filtered noise field contains frequency components at all relevant frequencies except for those in the bandpass window to be transmitted. Ions having m/z values outside the bandpass of interest acquire energy from the filtered noise field and are rejected, as is well known. The use of a filtered noise field (FNF) for rejection of ions outside an m/z value of interest is well-known and is described in several U.S. patents, including for example Langmuir et al. U.S. Pat. No. 3,065,640. An FNF source 134 is shown in dotted lines in FIG. 1.

Other methods of creating in substance a bandpass window may also be used. For example, a notch filter approach can be used, e.g. by rapidly scanning the RF and DC from power supply 56 up to a notch or pass band, and then above the notch or pass band, to reject precursors of interfering ions.

Figure 6A:
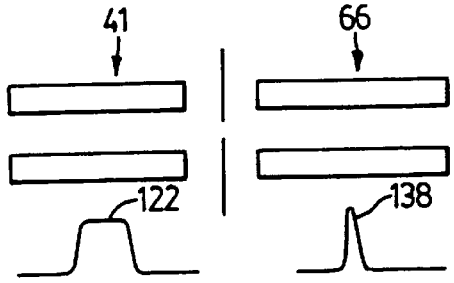
FIG. 6A is a diagrammatic view of a collision cell followed by an analyzer, with their pass band characteristics plotted therebelow.
Figure 6:
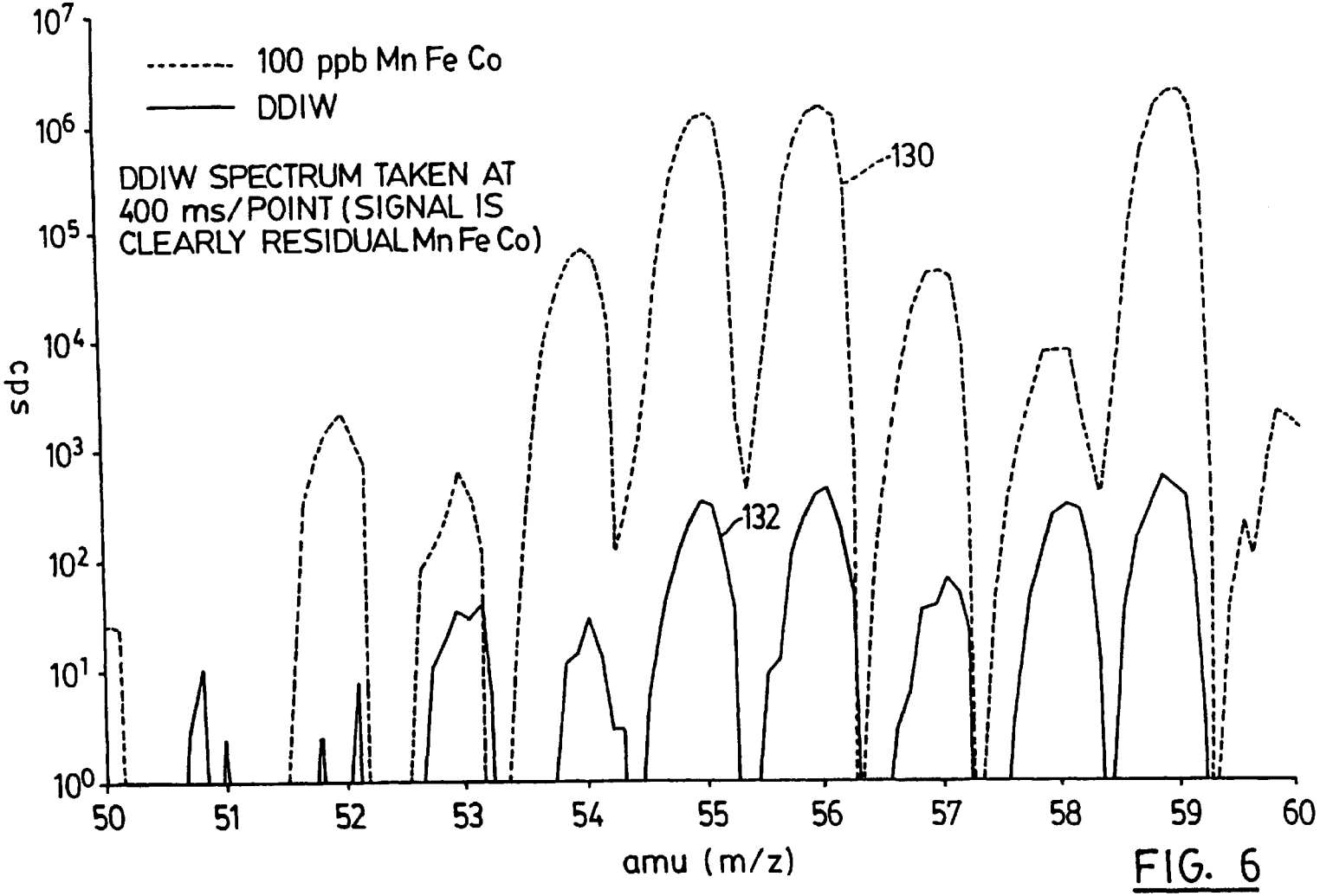
FIG. 6 shows two further mass spectra obtained using features of the invention.

The result, as shown in FIG. 6A, is that ions having m/z values within bandpass window 122 are transmitted through the collision cell 41, and then enter resolving spectrometer 66 which has a conventional narrow transmission peak 138, to resolve ions of interest. As mentioned, resolving spectrometer 66 can be a quadrupole or other multipole, or it can be a time-of-flight mass spectrometer, a sector instrument, or any other type of mass analyzer.

Figure 7:
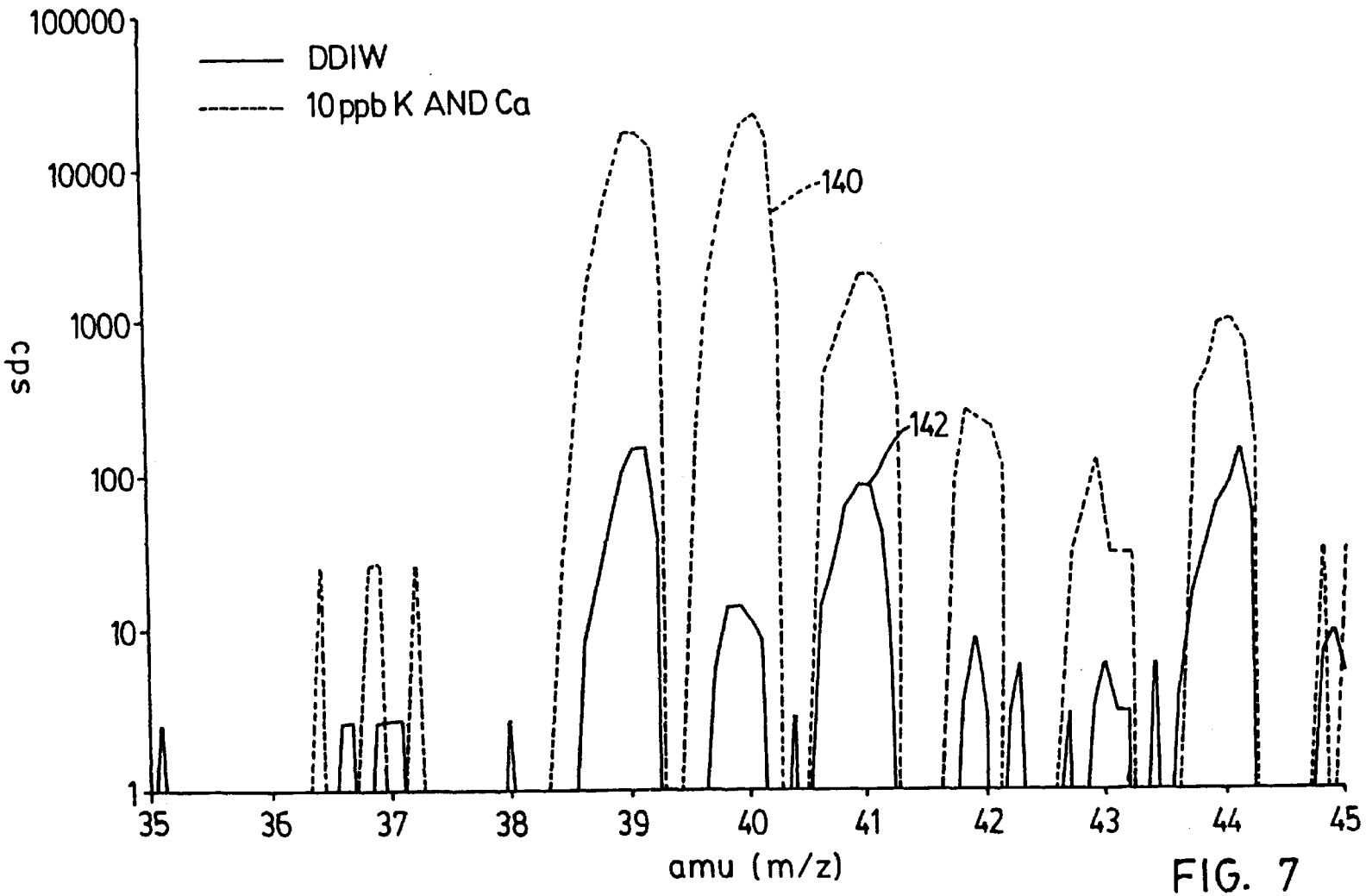
FIG. 7 shows two further mass spectra obtained using features of the invention.

Reference is next made to FIG. 7, which shows a mass spectrum 140 obtained using a sample containing 10 ppb K and Ca, and a second mass spectrum 142 obtained using distilled deionized water. The mass spectra of FIG. 7 were obtained as in connection with FIG. 5, using ammonia as a collision gas, with the collision cell operated at 1.2 MHz and 135 V RF (p-p), with 10 volts resolving DC. These RF and DC voltages yield q=0.660 and a=0.098, defined at m/z=40. Under these conditions of q and a, ions having m/z such that 33<m/z<90 are stable, under collisionless conditions.

It will be seen in FIG. 7 that calcium at mass 40 was far above the background signal. K39 and K44 were also well above the potassium contamination in the laboratory. (It is noted that the inventors have found that by operating the plasma at a relatively low temperature, it was possible to detect calcium down to 30 parts per trillion (ppt), but the system was very subject to interferences.) In FIG. 7, and for the other spectra shown, the normal hot plasma was used. The detection limit, e.g. in FIG. 7, was as low as a few ppt.

Figure 8:
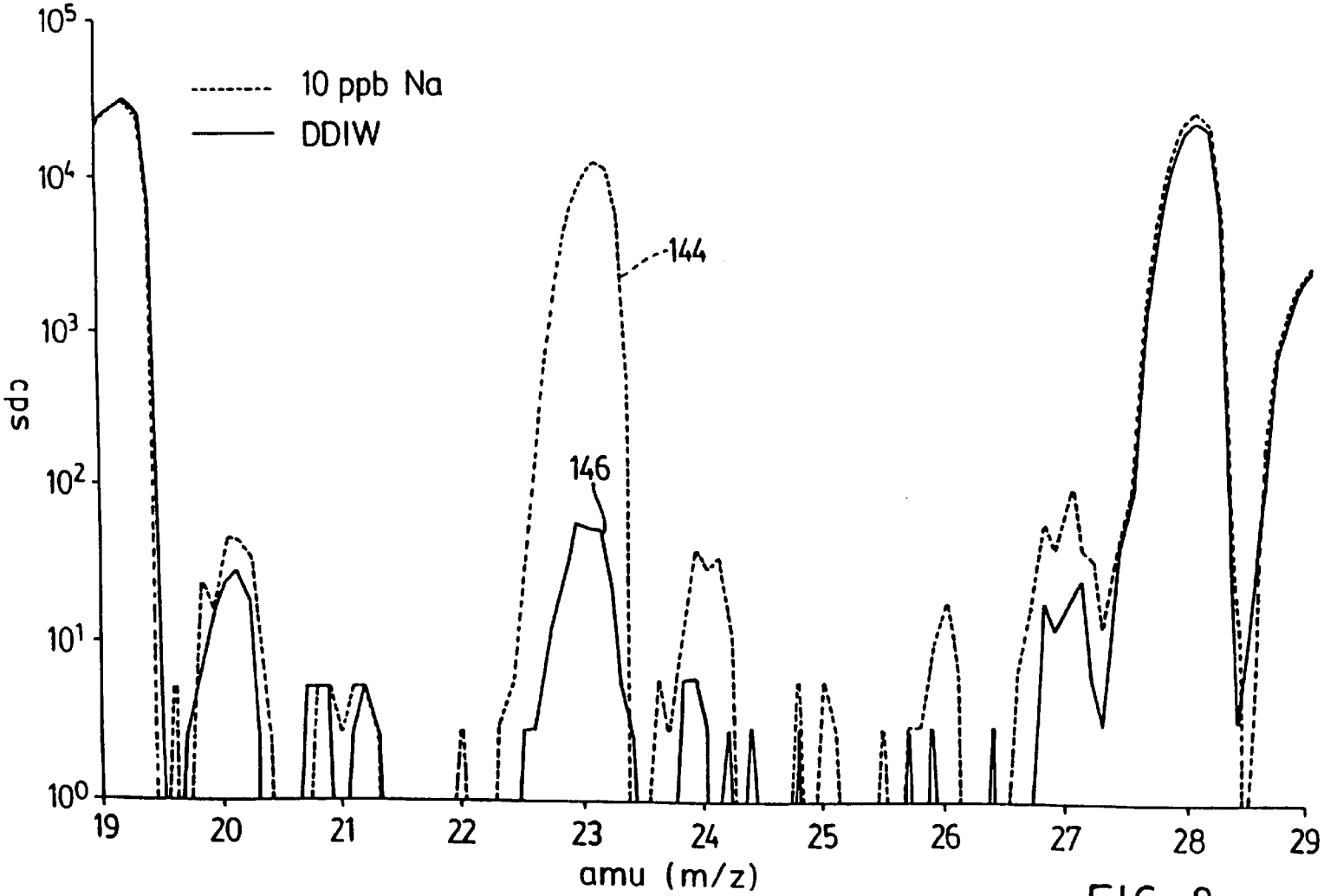
FIG. 8 shows two additional mass spectra obtained using features of the invention.

FIG. 8 shows a mass spectrum 144 obtained with a sample containing 10 ppb Na, and another spectrum 146 obtained using DDIW. Again the collision cell was operated using ammonia as a reactive collision gas, at 1.68 MHz and 139 V RF (p-p) with 11.9 volts resolving DC. These RF and DC voltages yield q=0.603 and a=0.103, defined at m/z=23. Under these conditions of a and q, ions having m/z such that 17<m/z<40 are stable, under collisionless conditions.

The upper trace or spectrum 144 shows Na clearly resolved at m/z=23. The background signals in the vicinity of Na were greatly suppressed, allowing virtually uninterfered determination of Na. Again, the residual signals resulting from the DDIW sample appeared to be significantly contaminated with the preceding sample, due to insufficient washout.

Figure 9:
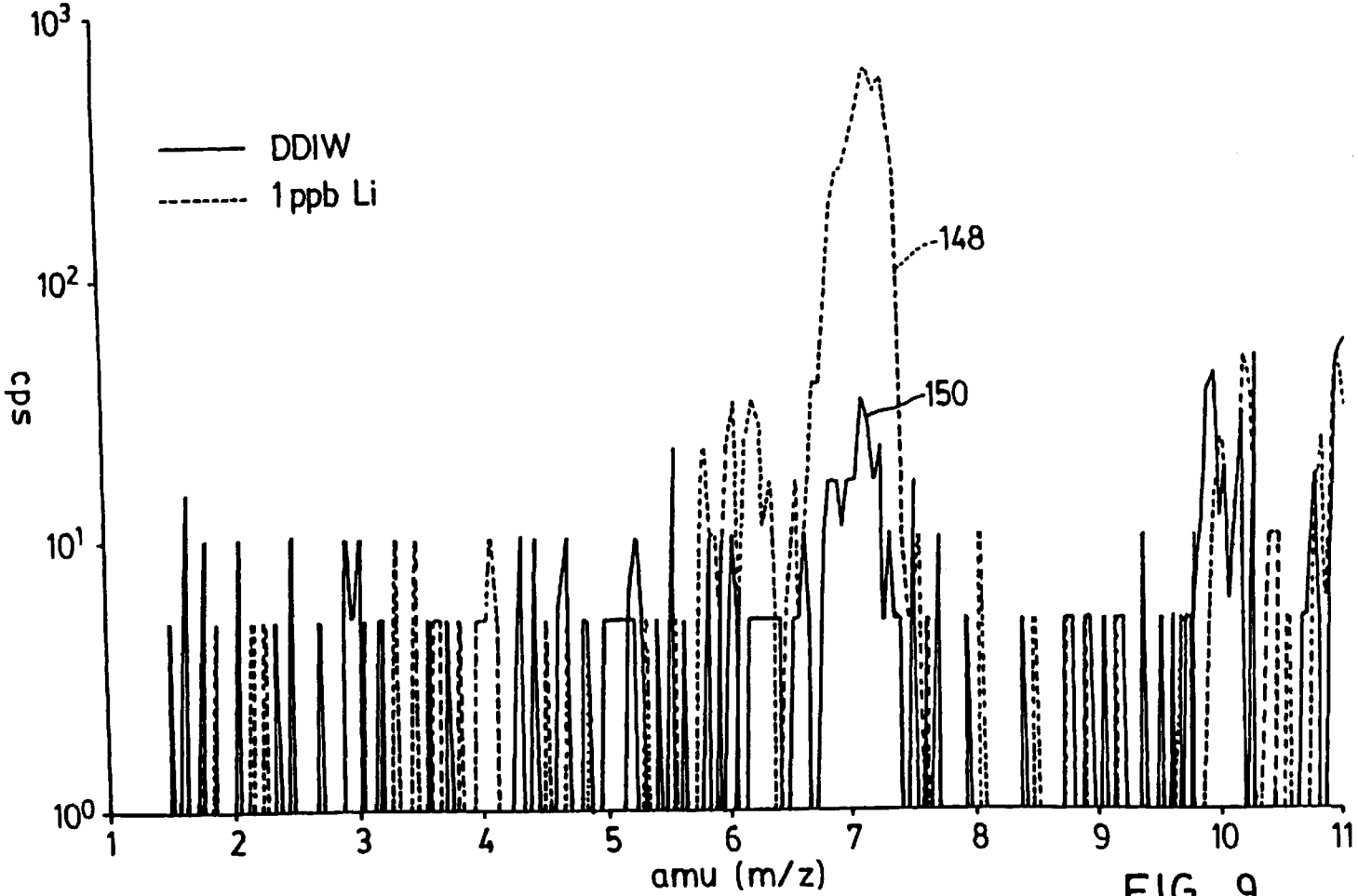
FIG. 9 shows two mass spectra obtained without the use of collision gas.

Reference is next made to FIG. 9, which shows two mass spectra, one spectrum 148 obtained with a sample of 1 ppb Li, and the other 150 obtained using DDIW. In this case no reactive collision gas was added. The collision cell therefore contained only plasma gas which had penetrated into it. In this case the collision cell was operated at 1.68 MHz and 39 V RF (p-p) with 3.1 volts resolving DC. These RF and DC voltages yield q=0.556 and a=0.088, defined at m/z=7. Under these conditions of q and a, ions having m/z such that 5<m/z<12 were stable under collisionless conditions. It will be seen that the background signals in the vicinity of Li at m/z=7 were significantly suppressed, allowing virtually uninterfered determination of Li. Again, the residual signals in the distilled deionized water sample appeared to be significantly contaminated with the preceding Li sample, due to insufficient washout.

Figure 10:
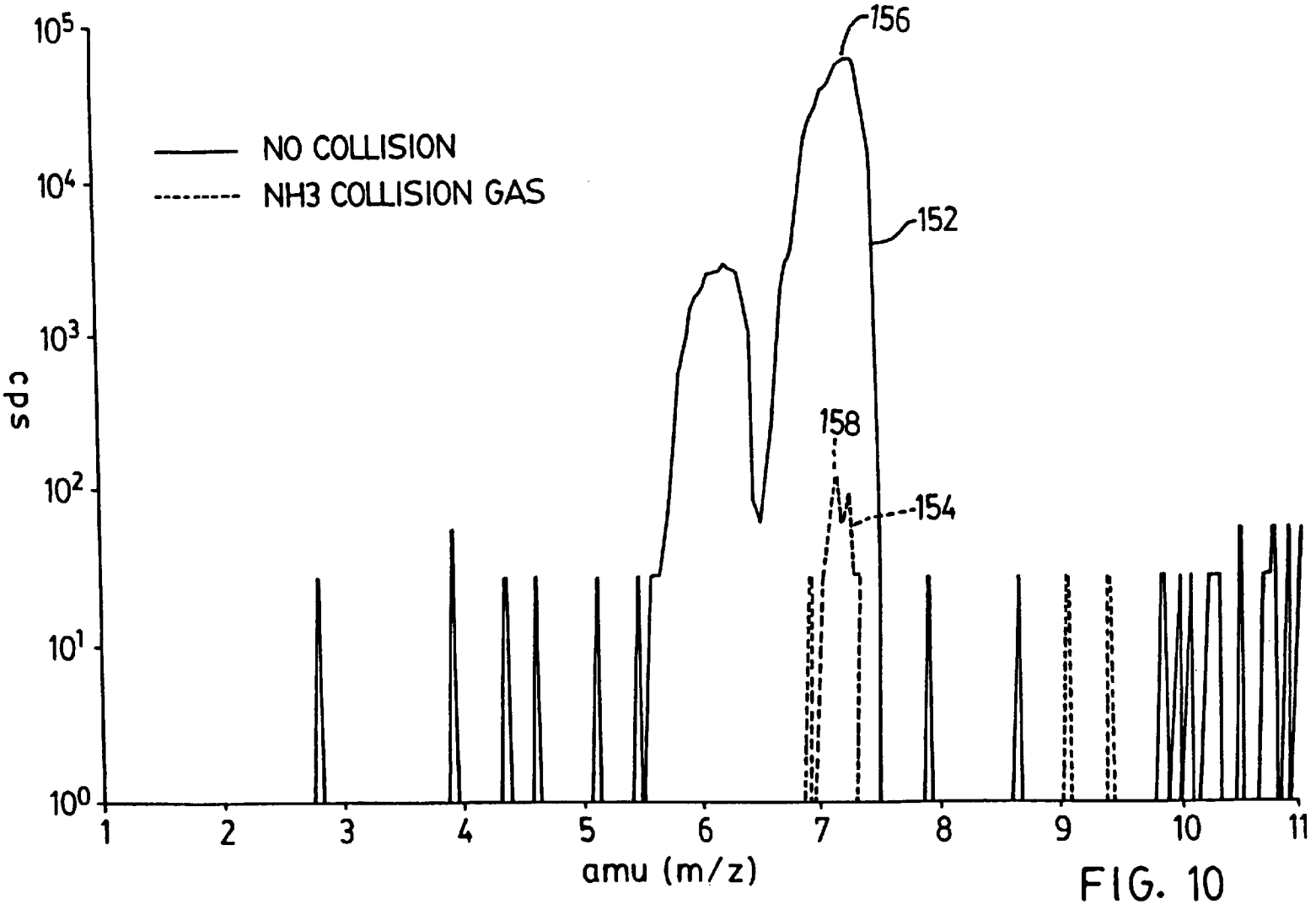
FIG. 10 shows two mass spectra similar to those of FIG. 9, one obtained with the use of collision gas and one without collision gas.

FIG. 10 shows two mass spectra 152, 154, both obtained using 100 ppb Li as a sample. The upper trace 152 corresponds to the situation shown in FIG. 9, with no added collision gas (so that the collision cell 41 contains only plasma gas which has penetrated into the collision cell), and shows a large peak 156 for lithium. The lower trace 154 corresponds to the case where reactive collision gas was added to the cell (here $NH_3$, yielding a cell pressure of about 20 millitorr). It will be seen that the addition of the reactive collision gas has suppressed the Li analyte signal from peak 156 (without the collision gas) to peak 158 (with the collision gas), evidently due to scattering losses.

Figure 11:
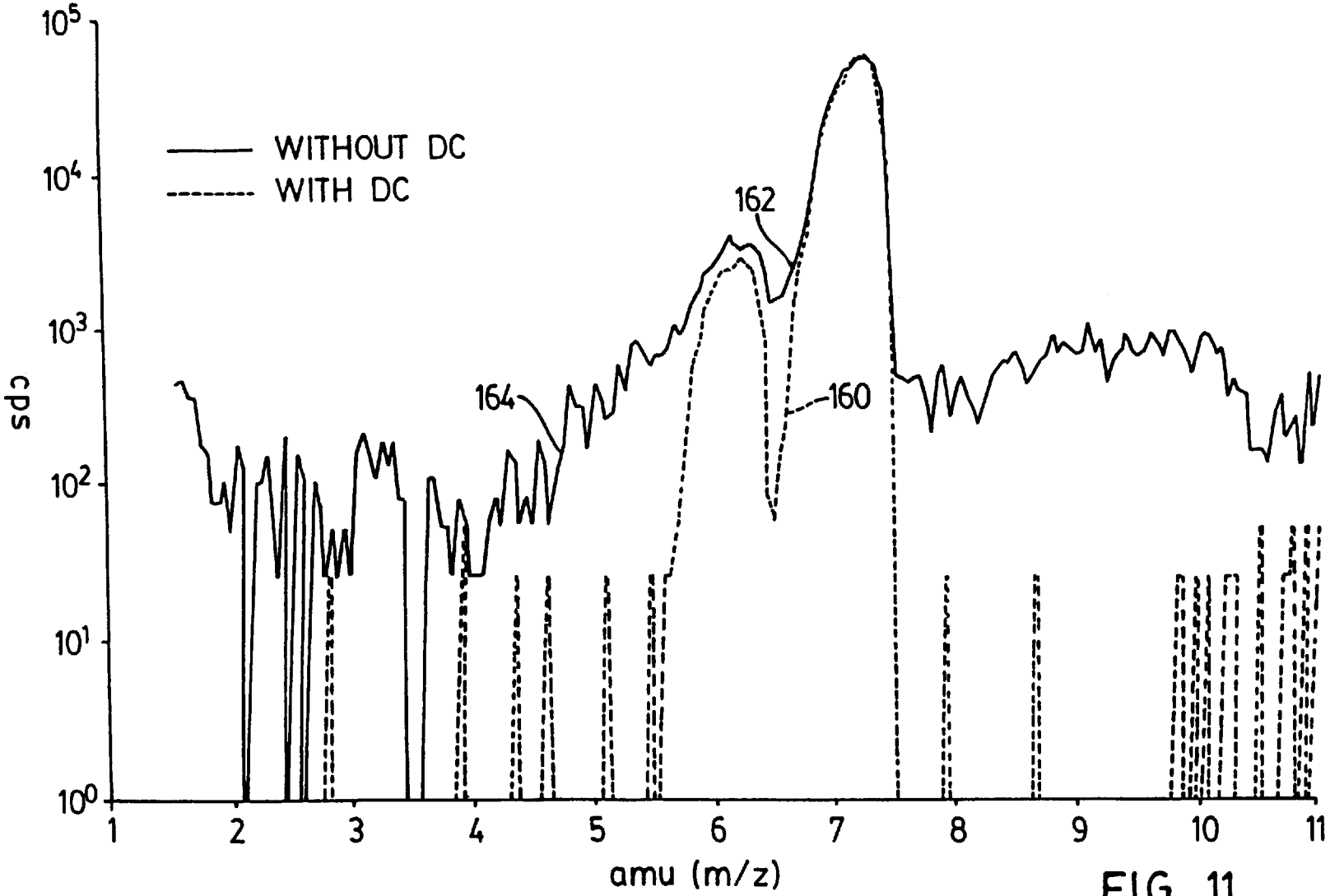
FIG. 11 shows two additional mass spectra, obtained with and without DC applied to the collision cell.

FIG. 11 shows two mass spectra 160, 162 again using a sample containing 100 ppb Li. For both mass spectra 160, 162, the collision cell was operated at 1.68 MHz, and 39 V RF (p-p), and with no added collision gas, but for trace 162 no resolving DC was added, while for trace 160, 3.1 volts DC (pole to pole) was added. The spectrum 160 obtained with the application of 3.1 V resolving DC was much better resolved, in that there was a reduced non-spectral background. The more poorly resolved spectrum 162, with elevated non-spectral background 164, was obtained without the use of resolving DC.

It should be noted that $Ar^+$ may contribute to the continuum background by producing metastable ions and neutrals, including $Ar^{+*}$ and $Ar^*$, which produce a background signal either directly (by impacting on the detector) or indirectly (by emitting a photon which strikes the detector). The background will be continuum if the source of the background signal is a metastable neutral (which is not affected by the mass filter). In FIG. 11, the bandpass produced by the application of resolving DC to the collision cell rejected the argon ions, thereby reducing interference from argon metastables.

Figure 12:
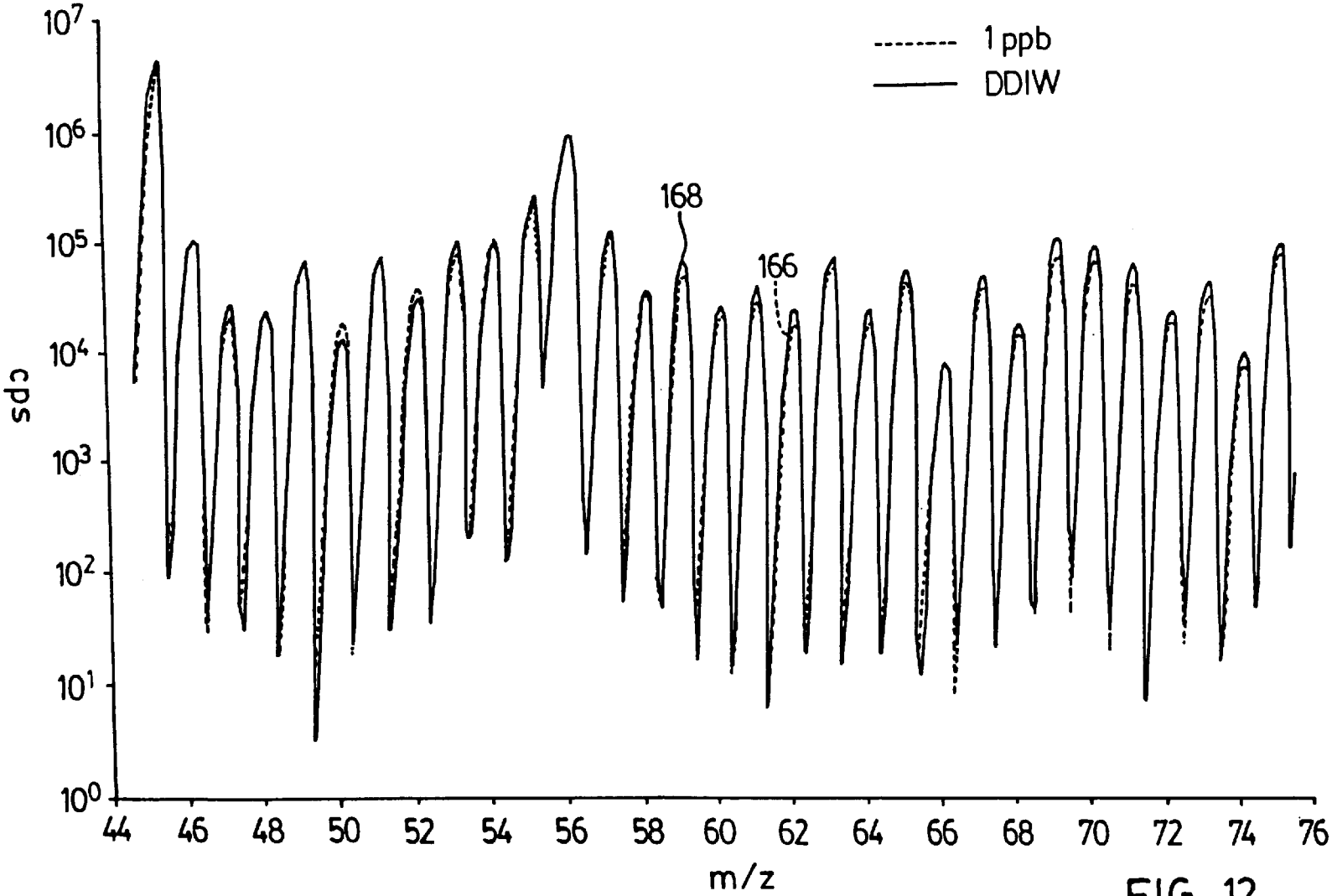
FIG. 12 shows two mass spectra, one using an analyte sample and the other using deionized distilled water, both without collision gas.

FIG. 12 shows two mass spectra 166, 168. The first mass spectrum 166 was obtained using a sample containing 1 ppb of each of Ti, Cr, Mn, Fe, Ni, Cu, Zn and As, as well as other analyte species having m/z values outside the range of the mass spectrum shown. The second spectrum 168 was obtained using DDIW. In both cases, no collision gas was used, so that the collision cell contained only plasma gas at a pressure of about 1 millitorr. (These are typical conditions when a collision cell is used as an ion injection device into a resolving mass spectrometer.) In both cases, RF-only (no DC) was applied at a frequency of 1.586 MHz and with V RF=200 volts p-p. Under these conditions of q and a, ions having m/z values>25 amu are stable under collisionless conditions. It will be seen that in both spectra, the analyte signals are obscured by the spectral background, which resulted primarily from reactions within the collision cell.

Figure 13:
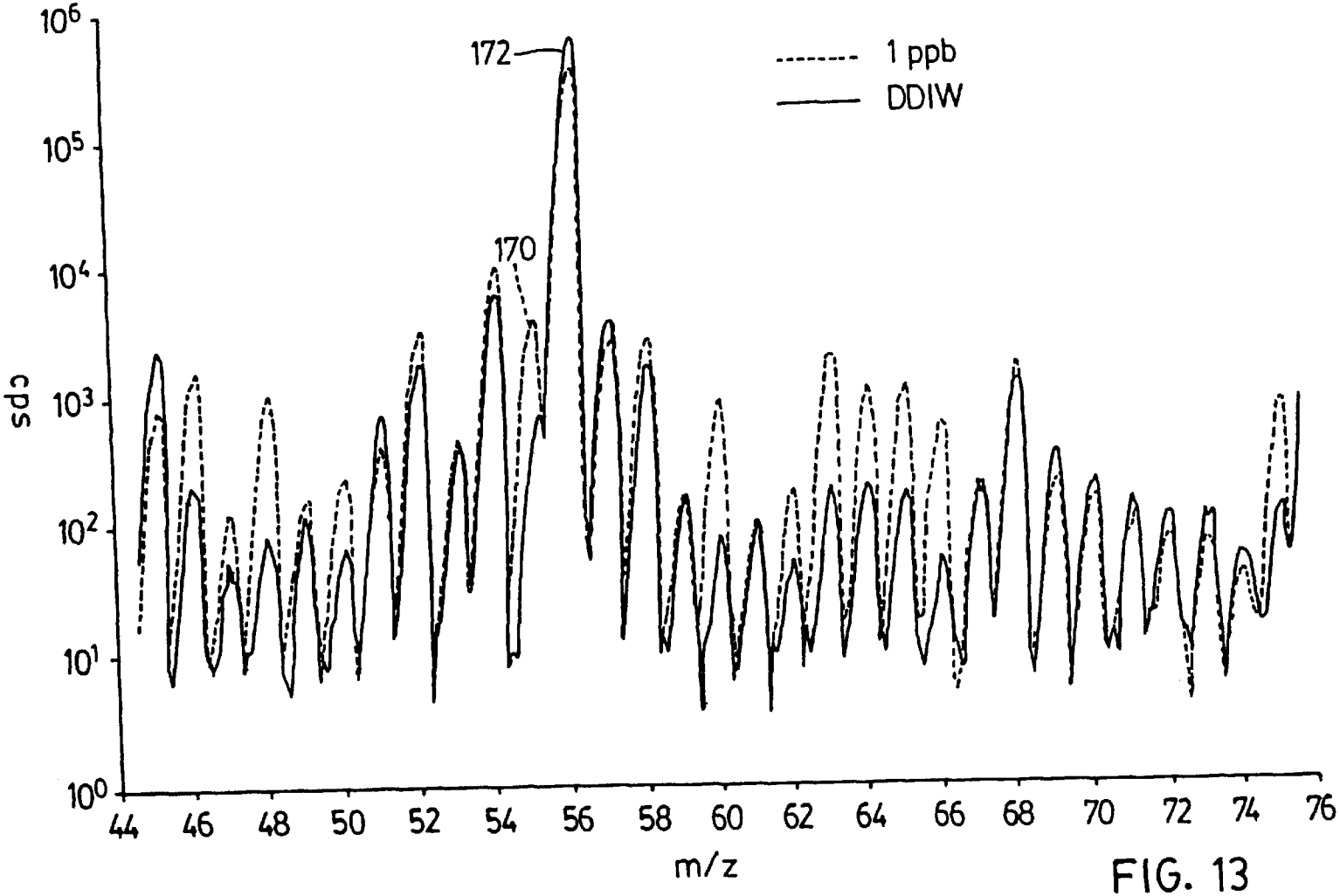
FIG. 13 shows two mass spectra obtained under conditions partly similar to those of FIG. 12, but with DC applied to the collision cell.

FIG. 13 shows two spectra 170, 172, obtained using the same samples as those of FIG. 12, and again without collision gas (so that the cell contained only plasma gas as before). However here, resolving DC at voltage V DC=14.5 volts, has been applied to the collision cell. The RF was 1.194 Mhz, V RF=200 volts p-p, yielding q=0.7 and a=0.1, defined at m/z=56. Under these conditions of q and a, ions having m/z such that 49<m/z<138 were stable, under collisionless conditions.

It will be seen that adding the DC to create a bandpass window near m/z=56 reduces the spectral background to a very large extent, so that the sample signal can now be observed. Although argon oxide at mass 56 was not removed, components due to organic isobaric interferences were removed.

Figure 14:
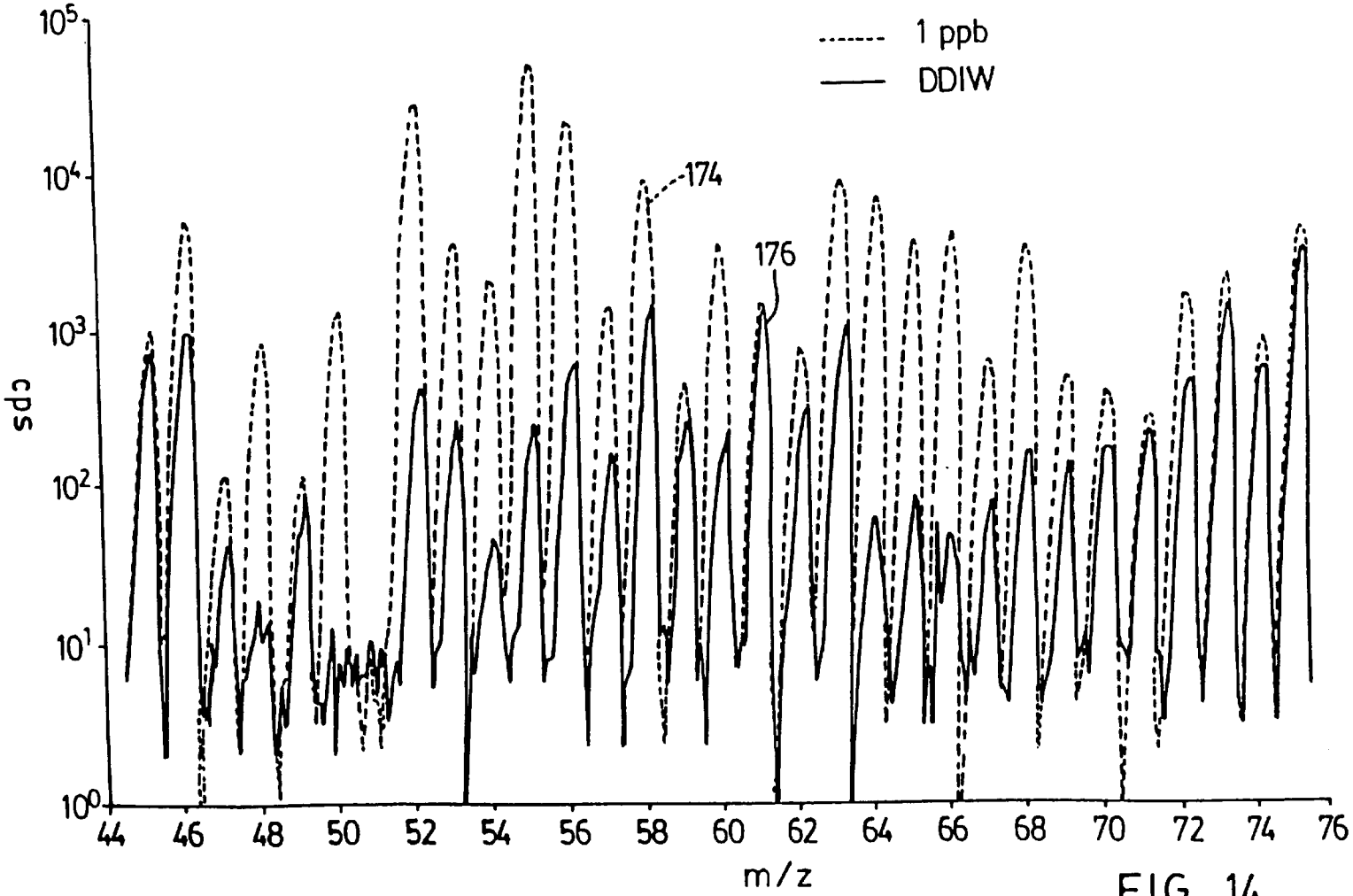
FIG. 14 shows two mass spectra obtained under conditions similar to those of FIG. 12, but with collision gas present.

FIG. 14 shows two mass spectra 174, 176, again using the same sample as in FIG. 12, but here the reactive collision cell 41 has been pressurized with $NH_3$ to a pressure of about 30 millitorr. No resolving DC was applied. RF was applied at 1.586 MHz, V RF=200 volts, yielding q=0.4 and a=0. Under these conditions of q and a, ions having m/z>25 amu are stable, under collisionless conditions. It will be seen that the spectral background signals from FIG. 12 have been suppressed and the analyte signals enhanced relative to those of FIG. 12.

Figure 15:
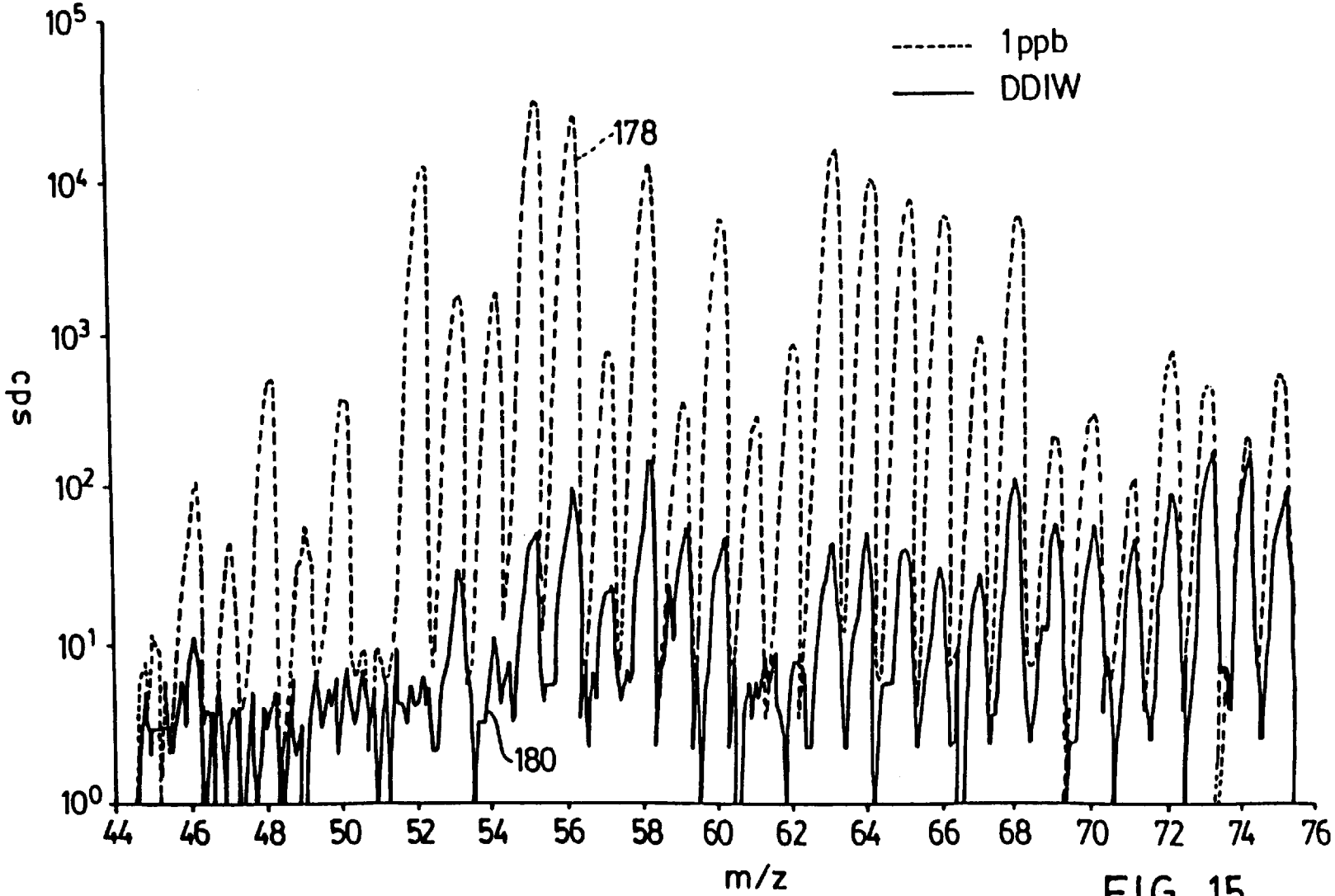
FIG. 15 shows two mass spectra obtained under conditions similar to those of FIG. 14, but with a different q.

FIG. 15 shows two mass spectra 178, 180, obtained under conditions similar to those of FIG. 14 (again with reactive collision gas $NH_3$), but the q has been increased to q=0.7 (using RF at 1.194 MHz, V RF=200 volts), and with a=0 (no DC). Under these conditions of q and a, ions having m/z>44 amu are stable, under collisionless conditions. It will be seen here that in spectrum 178, the background was greatly reduced, evidently because at higher q, producing a higher low mass cut off, intermediate ions that may produce interference ions have been removed.

Figure 16:
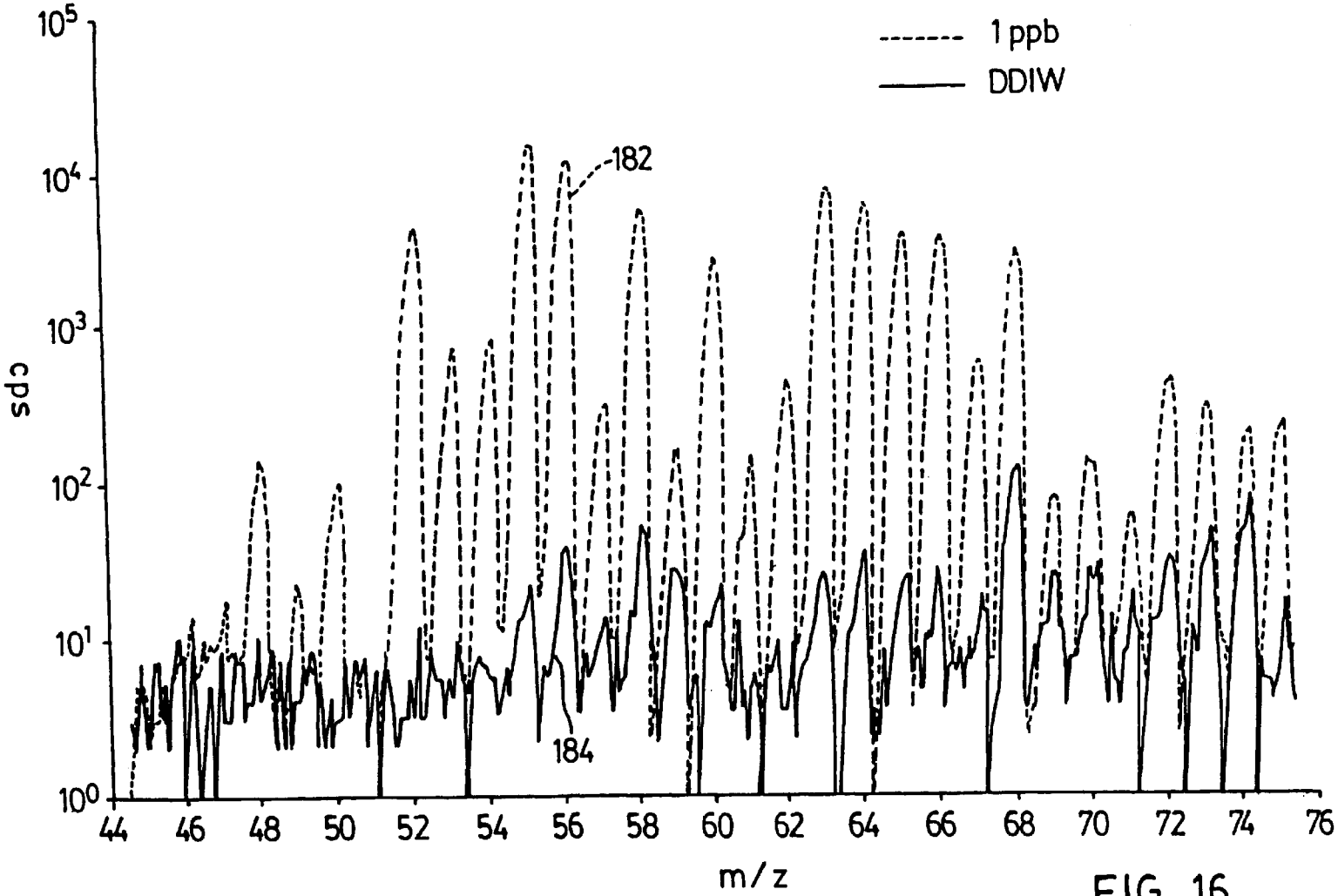
FIG. 16 shows two mass spectra obtained under conditions similar to those of FIG. 15, but with resolving DC applied (and also similar to those of FIG. 13 but with collision gas)

FIG. 16 shows two mass spectra 182, 184 obtained using the same samples as those of FIG. 15, and under conditions similar to those of FIG. 15 except that a small amount of resolving DC has been added (which of course increased "a" from zero to a finite value). As before, the RF was 1.194 MHz at V RF=200 volts, but 14.5 volts DC were applied, yielding q=0.7 and a=0.1. Under these conditions of q and a, ions having m/z such that 49<m/z<138 were stable under collisionless conditions. Here, some improvement in the ratio of analyte signals to background signals was obtained, resulting from the high mass cut off which eliminated some interfering ions.

Figure 17:
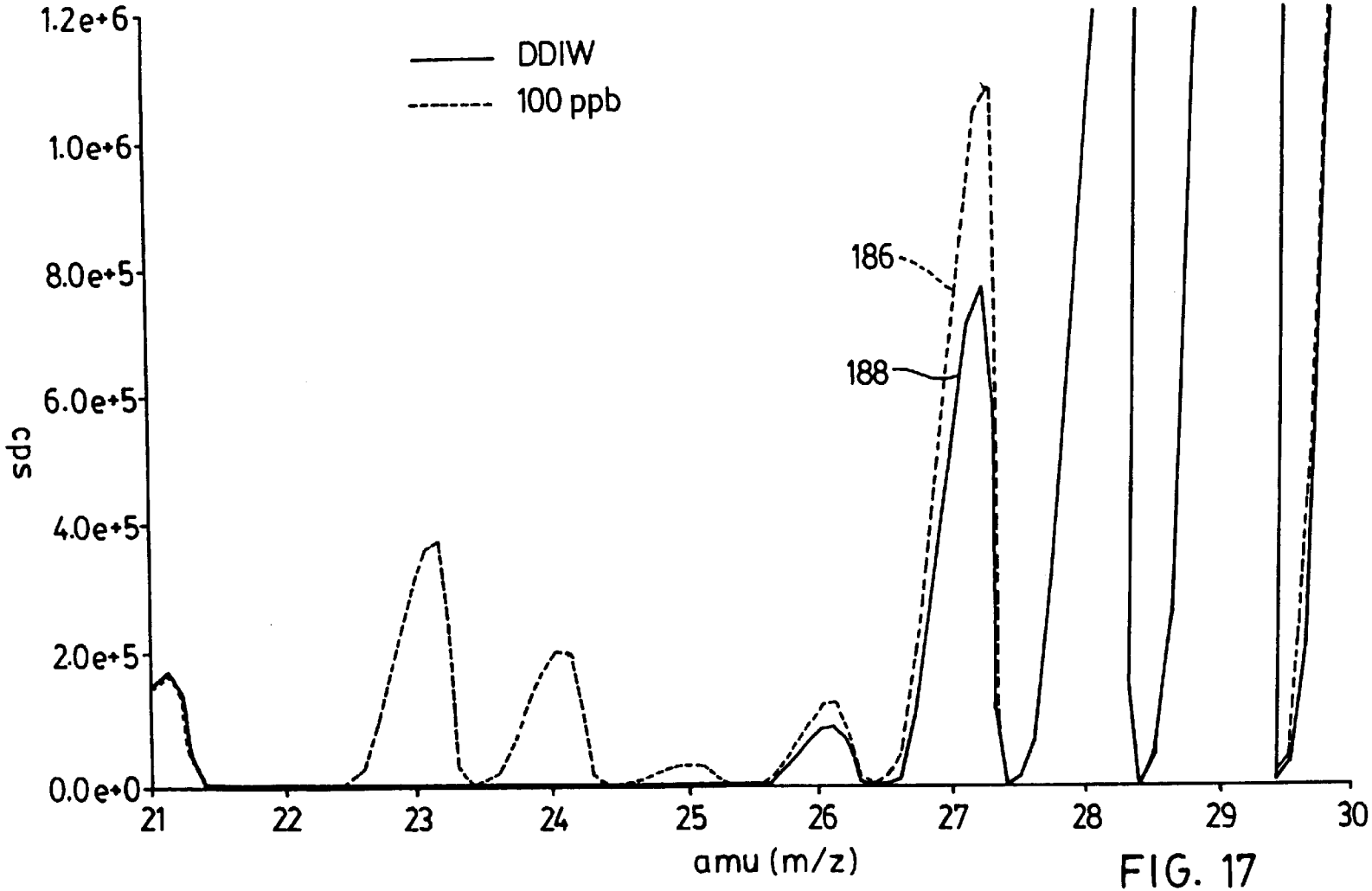
FIG. 17 shows two mass spectra obtained for aluminum.

FIG. 17 shows a mass spectrum 186 obtained using the FIG. 1 apparatus under typical collision cell conditions, with a sample containing 1 ppb of each of Na, Mg and Al (as well as other analyte species having m/z outside the range of the mass spectrum shown). FIG. 17 also shows a second mass spectrum 188 obtained under the same conditions but using DDIW. In the typical collision cell conditions used for FIG. 17, q=0.4 (RF was 2.28 MHz and V RF=200 V p-p), while a=0. Under these conditions of q and a, ions having m/z>12 amu are stable under collisionless conditions. A collision gas mixture was used containing 40% $H_2$ in He, with a collision gas pressure of about 10 millitorr. It will be seen that a large isobaric interference at m/z=27 obscured the determination of Al at m/z 27. This is typical of conventional collision cells.

Figure 18:
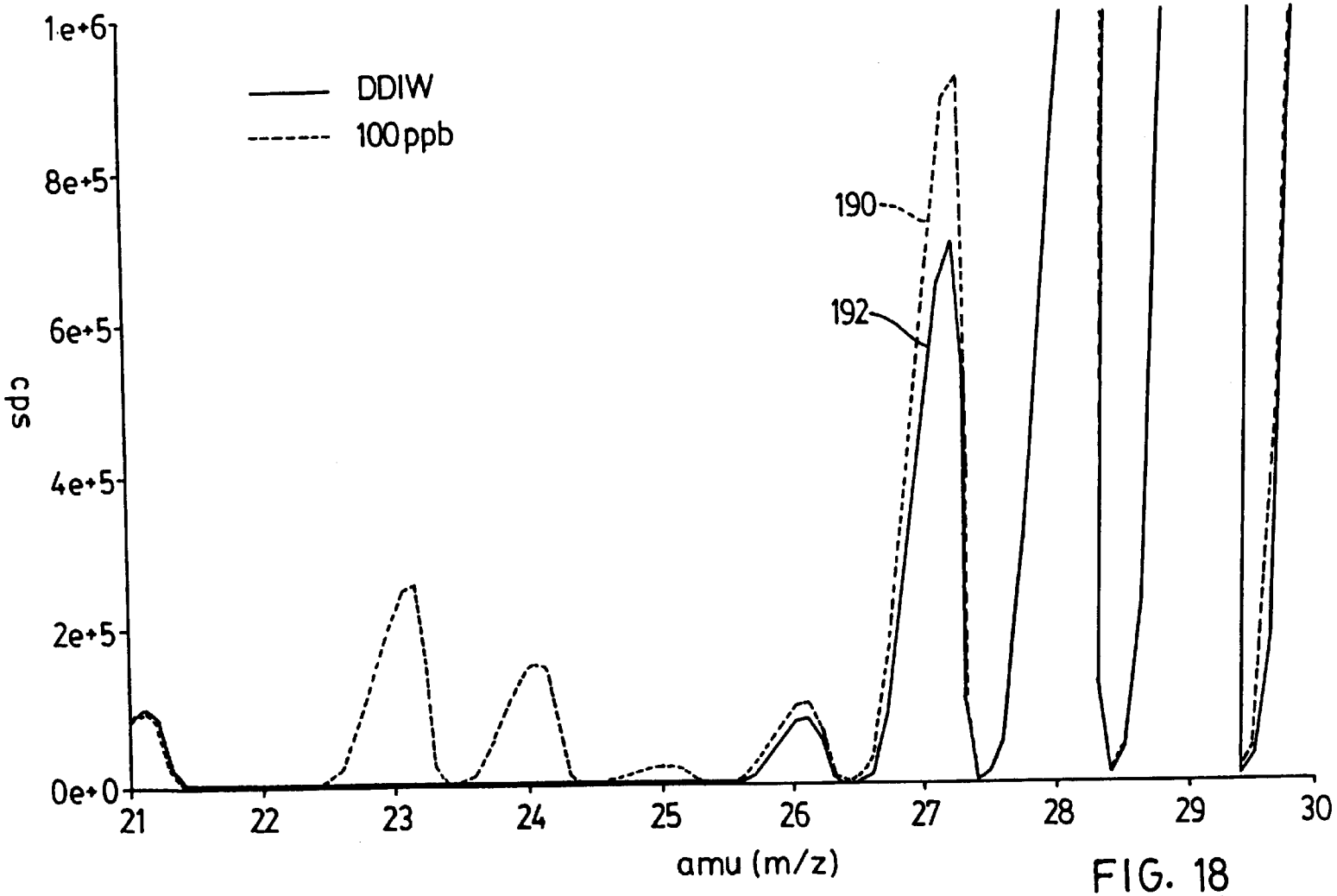
FIG. 18 shows two mass spectra obtained under conditions similar to those of FIG. 17, but with increased q.

FIG. 18 shows two spectra 190, 192 corresponding respectively to those of FIG. 17, and produced under the same conditions except that q was increased to q=0.57. Here, the RF was applied at 1.91 MHz, V RF=200 V p-p, a=0. Under these conditions of q and a, ions having m/z>17 amu are stable under collisionless conditions. Again a collision gas of 40% $H_2$ in He was used. It will be seen that in this case, the increase in q did not significantly suppress the background signal at m/z=27.

Figure 19:
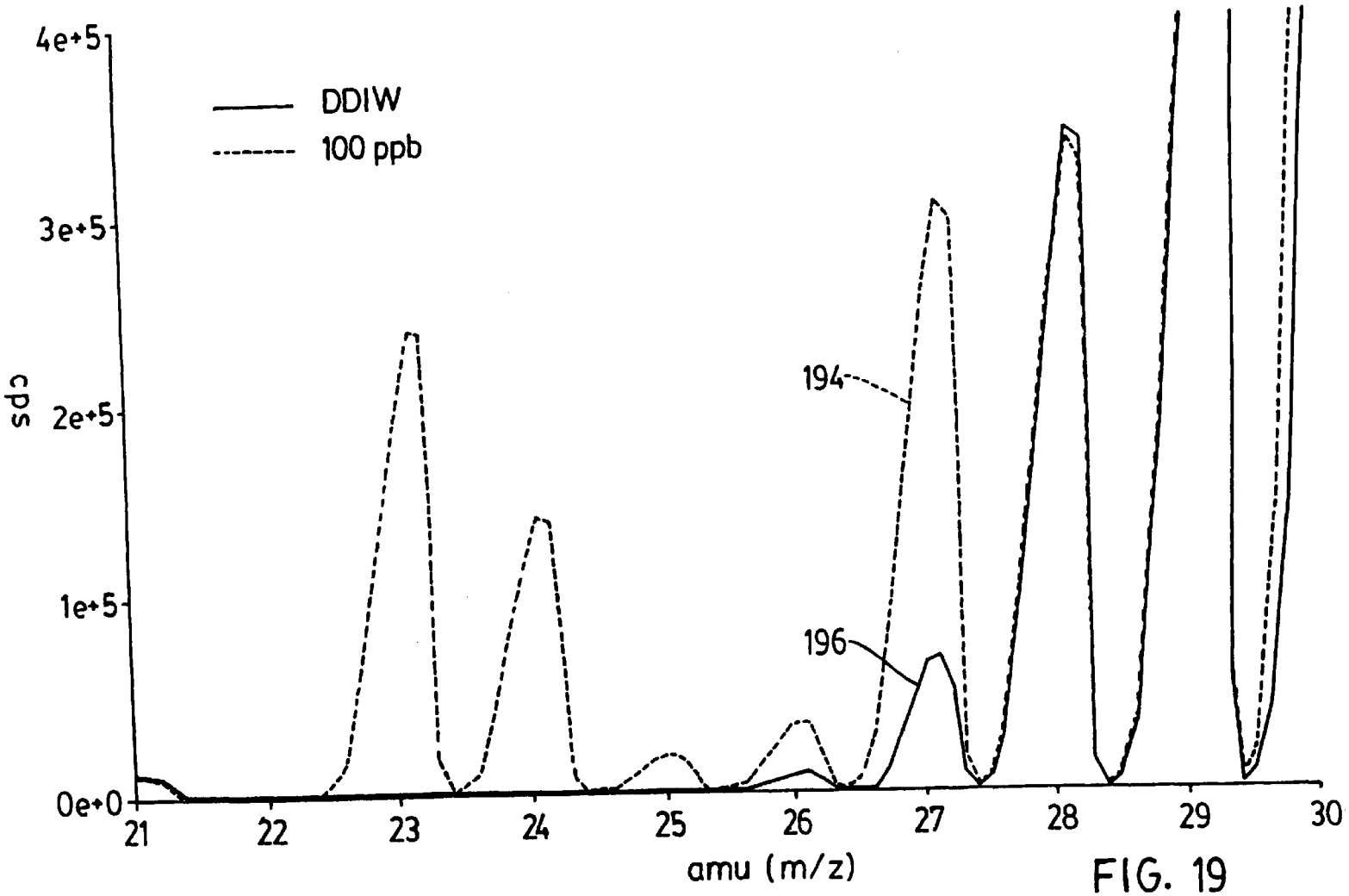
FIG. 19 shows two mass spectra obtained under conditions similar to those of FIG. 18, except that resolving DC has been applied.

FIG. 19 shows two mass spectra 194, 196 corresponding to those of FIGS. 17 and 18, with the same samples, and with the same q as for FIG. 18, but in this case resolving DC has been added so that q=0.57 and a=0.08, defined at m/z=27 (for aluminum). Again RF was applied at 1.91 MHz, V RF=200 V p-p, but 14.25 volts resolving DC were applied. Under these conditions of q and a, ions having m/z such that 19<m/z<55 were stable, under collisionless conditions.

It will be seen from FIG. 19 that the addition of a resolving DC component significantly suppressed the background signal at m/z=27, while not affecting the net signal obtained for the Al analyte. The result was a large improvement in the ability to determine Al. In this case, the high mass cutoff of the bandpass window clearly removed isobaric interferences.

In the embodiments described, it has been assumed that ions from analyzer 66 are detected for analysis. However if desired, these ions may be subjected to a variety of further processes. For example, ions selected by analyzer 66 can be directed into a conventional collision cell, shown at 200 in FIG. 20 (where primed reference numerals indicate parts corresponding to those of FIG. 1), fragmented there to form daughter ions (or reacted there to form product ions), and may then be passed through a further analyzer 202 before ultimate detection and analysis.

In addition, if desired, mass analyzer 66' can be eliminated, and selection of ions (depending on the analyte used) may be performed in bandpass collision cell 41'. For example, if the analyte in question produces only two ions, one being of interest and the other being an interfering ion or a precursor to an interfering ion, then cell 41 can be used to remove the interfering ion or the precursor to the interfering ion, in which case the ion of interest from reactive collision cell 41' is transmitted directly into conventional collision cell 200 for fragmentation, after which the daughter ions are analyzed as before in analyzer 202 (which although shown as a multipole can of course be any kind of analyzer).

Figure 20:
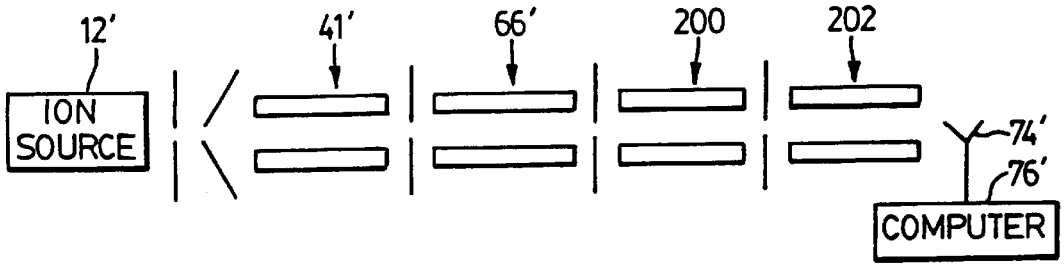
FIG. 20 is a diagrammatic view of a modification of the FIG. 1 apparatus.
Figure 21:
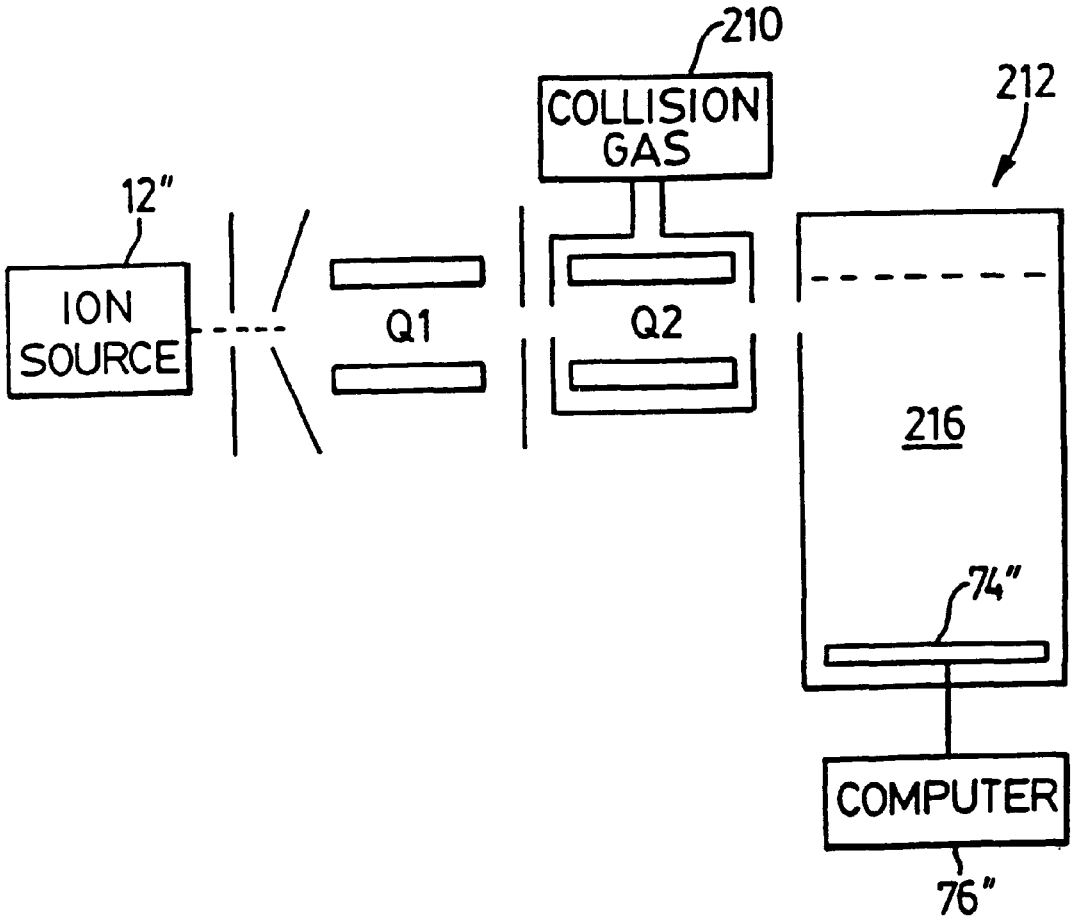
FIG. 21 is a diagrammatic view of another mass spectrometer system for use according to the invention.

Reference is next made to FIG. 21, where double primed reference numerals indicate parts corresponding to those of FIGS. 1 and 20. As shown, FIG. 21 shows a conventional ion source 12", which provides a stream of ions for analysis into a resolving mass spectrometer Q1 (which may if desired be preceded by an ion transmission device such as cell 41 (not shown). Resolving spectrometer Q1 selects parent ions of interest, which are then injected into a standard collision cell Q2 supplied with collision gas from source 210. Analyzers Q1, Q2 are typically but not necessarily quadrupole mass spectrometers.

In collision cell Q2, the parent ions transmitted through analyzer Q1 are fragmented to form daughter ions, which are injected into a conventional time-of-flight (TOF) mass spectrometer 212 for detection by detector 74' and analysis by computer 76".

As is well known, in a TOF mass spectrometer ions are injected into the flight tube 216 in a pulse and have different flight times before reaching the detector 74". The heavier ions travel more slowly through the flight tube than the lighter ions. One limitation of the duty cycle of a TOF mass spectrometer is that sufficient time must be allowed for transit of the slowest ions through the flight tube to the detector 74", before a subsequent pulse of ions can be introduced into the flight tube. This is necessary to avoid overlap of the flight times of the heaviest ions from the first pulse with the lightest ions of the second pulse.

According to the invention, the collision cell Q2 may be operated with an appropriate bandpass defined by a high mass cutoff, to restrict the upper mass range of ions introduced into the flight tube 216. This can provide a major improvement in the duty cycle. By way of example (which is not intended to be limiting), if the m/z values of the heaviest daughter ions produced in collision cell Q2 are 2,000 amu, and if the high mass cutoff is limited to 200 m/z amu, then the duty cycle of the TOF 212 can be improved by a factor of 10, which is very substantial.

The low mass cutoff of the collision cell Q2, provided by the stability limit defined primarily by the RF, will provide a similar but probably less important improvement in duty cycle.

It will be realized that for this application, the collision cell Q2 may be operated either with or without collision gas. When operated without collision gas, it functions essentially as an ion transmission device, limiting ions which it passes to a range of m/z values within a selected pass band. The width of the selected pass band will depend on the particular chemistry involved.

It will also be realized that as previously described, the pass band of the collision cell Q2 may be determined by application of appropriate RF and DC voltages, or by use of a filtered noise field (FNF), or by notch filtering, or by other appropriate means.

Where RF and DC voltages are used in an ion transmission device according to the invention, to set a pass band, the DC voltage will normally be much less than that employed for a conventional analyzing DC quadrupole. Normally, in a conventional analyzing quadrupole the DC level is set such that a=0.234. In the bandpass device of the invention, it is preferred to use a relatively low level DC, to improve the ion transmission capability of the device, while still obtaining the desired bandpass characteristics. Typically "a" will not be greater than about 0.15, and may (as shown in the examples described) be considerably less.

Regardless of the particular method used to establish low mass and high mass cutoffs, the width of the pass band between these cutoffs can vary depending on the application. For example, this width varies from a high of 233 amu in connection with FIG. 6 to a low of 7 amu in connection with FIG. 9. The width of the pass band (where there are low and high mass cutoffs) will always be less than the mass range which the device would be capable of transmitting if operated in RF-only mode, but greater than that which would be transmitted if the device were operated in normal resolving mode (at the tip of the stability diagram, where most devices can now resolve down to about 1 amu, or less).

Figure 22:
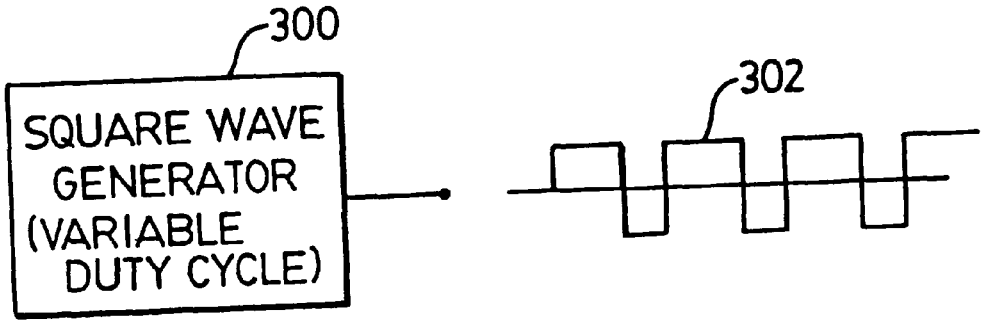
FIG. 22 is a block diagram showing an alternative power supply and the wave form produced by it.

While it has been assumed that DC is supplied to the rods of quadrupole 34 using a conventional DC source in power supply 56, DC can in fact be supplied in any desired way. For example, as shown in FIG. 22, power supply 300 can be a square wave generator generating a square wave 302 at RF frequencies and having a variable duty cycle which can range from 0.5 to a higher or lower value. The departure of the duty cycle from 0.5 (e.g., so that the positive going pulses are larger than the negative going pulses) is equivalent to the application of a mean DC potential and results in the benefits previously described for the use of low level DC.

It will also be realized that in many cases, analytes can readily be determined at useful levels without the need and complexity of a reactive collision cell such as quadrupole 34. In fact in some cases, the determination of some analytes may be compromised by the presence of a reactive collision cell, even if no collision gas is added. Therefore, in some modes of operation it may be desired to convert the reactive collision cell 34 to an AC only pre-filter mode, and to do so in the midst of a sample analysis. The following description deals with this aspect of the invention.

In more detail, it may be common to position the reactive collision cell 34 as the interface between two vacuum chambers at different pressures (e.g., with the entrance to the reactive collision cell 34 located in chamber 28 of FIG. 1 and the exit in chamber 60 of FIG. 1. If no collision gas is added to the collision cell (e.g., through conduit 44), then the pressure within the collision cell will be intermediate between the pressures in chambers 28 and 60. As noted previously in this description, the gas which is contained in the cell 34 under these conditions is the gas contained within the higher pressure chamber, e.g., chamber 28. This gas is primarily obtained from the plasma flow through the skimmer aperture 22. The plasma gas may contain components (e.g., O, H, NO, $H_2O$, etc.) which are reactive with some of the analyte ions. In addition, the plasma gas is primarily composed of Ar (for an argon ICP), which as noted earlier can contribute to an elevated continuum (non-spectral) background due to excitation to metastable neutrals by collisions with energetic ions such as $Ar^+$.

Under these circumstances, the pressure within the collision cell 34 will be proportional to the diameters of the entrance and exit apertures of the collision cell. Unless the diameter of the aperture leading to the lower pressure chamber (e.g., chamber 60) is much larger than the diameter of the aperture opening into the higher pressure chamber (e.g., chamber 28), the pressure within the collision cell may be sufficient to promote a significant degree of chemical reaction. Such reactions may give rise to the formation of spectral interferences due to ionization of components of the plasma gas, or due to reactions with contaminant molecules within the cell. Further, some analyte ions may react with the plasma gases contained within the cell, resulting in loss of analyte signal for these reactive analyte ions. Therefore, operation of the collision cell even without the addition of a collision gas may give rise to an elevated background (non-spectral) and an elevated spectral background, and possibly to loss of some analyte signals, in some analysis circumstances.

Therefore, when collision gas is not added to the collision cell, it may be desirable in some circumstances to vent the collision cell 34 to the higher vacuum chamber (e.g., chamber 60), in order to reduce the pressure within the collision cell when collision gas is not used. With sufficient venting of the collision cell to the high vacuum chamber, new spectral background may be reduced or eliminated. It may be most convenient to do this by increasing the diameter of the exit aperture of the collision cell. However, the collision cell may be operated at a different frequency, or at a substantially different RF amplitude, than the pre-filter multipole 64 or the analyzing multipole 66 if a pre-filter is not used. If the increased diameter of the exit aperture is sufficiently large to allow capacitive coupling of the collision cell multipole with the pre-filter or the analyzing multipole, then a means should be provided to prevent this capacitive coupling.

Figure 23:
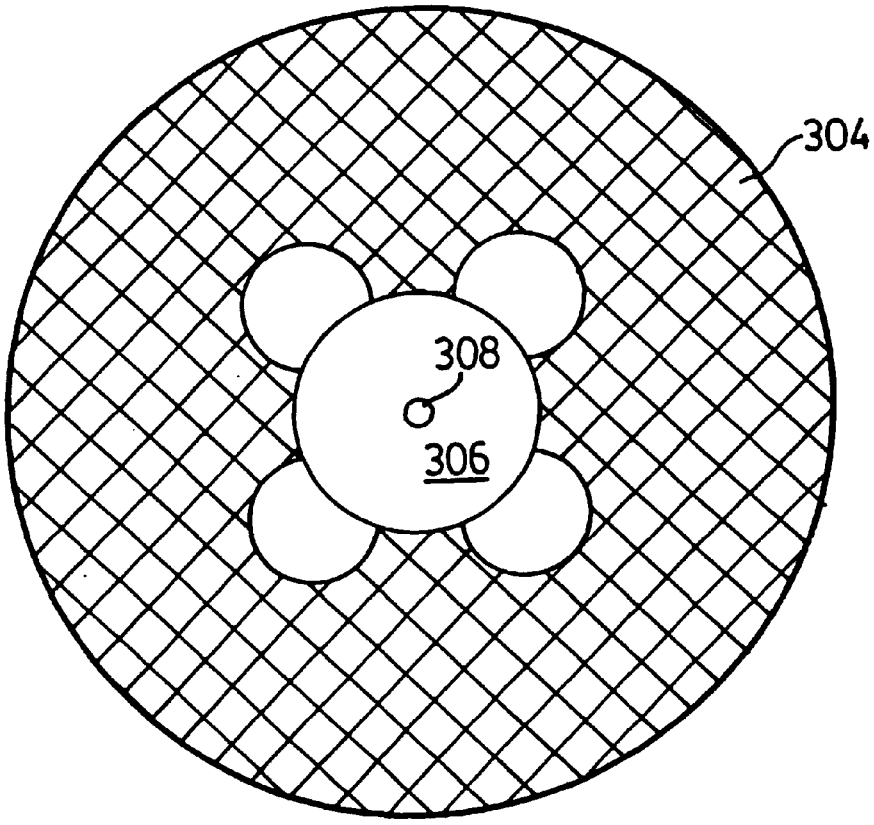
FIG. 23 is a plan view showing a washer and mesh used to reduce capacitive coupling between successive cells.

One way of reducing the capacitive coupling is to place a conductive mesh filter with appropriate dimensions between the collision cell 34 and the following multipole (e.g., multipole 64 or 66). However, if the diameter of the exit aperture is large, it is found that the continuum (non-spectral) background signal is increased. It is found that this elevated continuum background can be reduced or eliminated by at least partially blocking the exit plane of the collision cell. This can conveniently be achieved by installing a washer-type aperture plate on the axis between the collision cell (e.g., quadrupole 34) and the pre-filter 64. As shown in FIG. 23, if a mesh material 304 is used to isolate the collision cell 34 from the pre-filter 64, then a washer-type aperture plate 306 may be affixed to the mesh material 304. The washer-type plate 306 has a small central opening 308 to allow passage of ions which are travelling close to the axis of the collision cell 34. If the outside diameter of plate 306 is sufficiently large to reduce the continuum background signal but sufficiently small to allow efficient evacuation of the collision cell around its outside, i.e., through the mesh material 306 then the resultant spectrum may be freer of continuum (non-spectral) and also spectral interference which would otherwise be generated within the collision cell due to the elevated pressure.

In FIG. 23, the outside diameter of the isolating mesh material 304 is preferably the same as or greater than the diameter of the can 36 containing the collision cell 34. The outside diameter of the washer-type aperture plate 306 is approximately the same as or slightly larger than the inscribed diameter of the multipole collision cell 34. The inside diameter of the opening 308 in plate 306 is sufficient to allow good ion transmission out of the cell 34 while maintaining a low continuum background.

Figure 24:
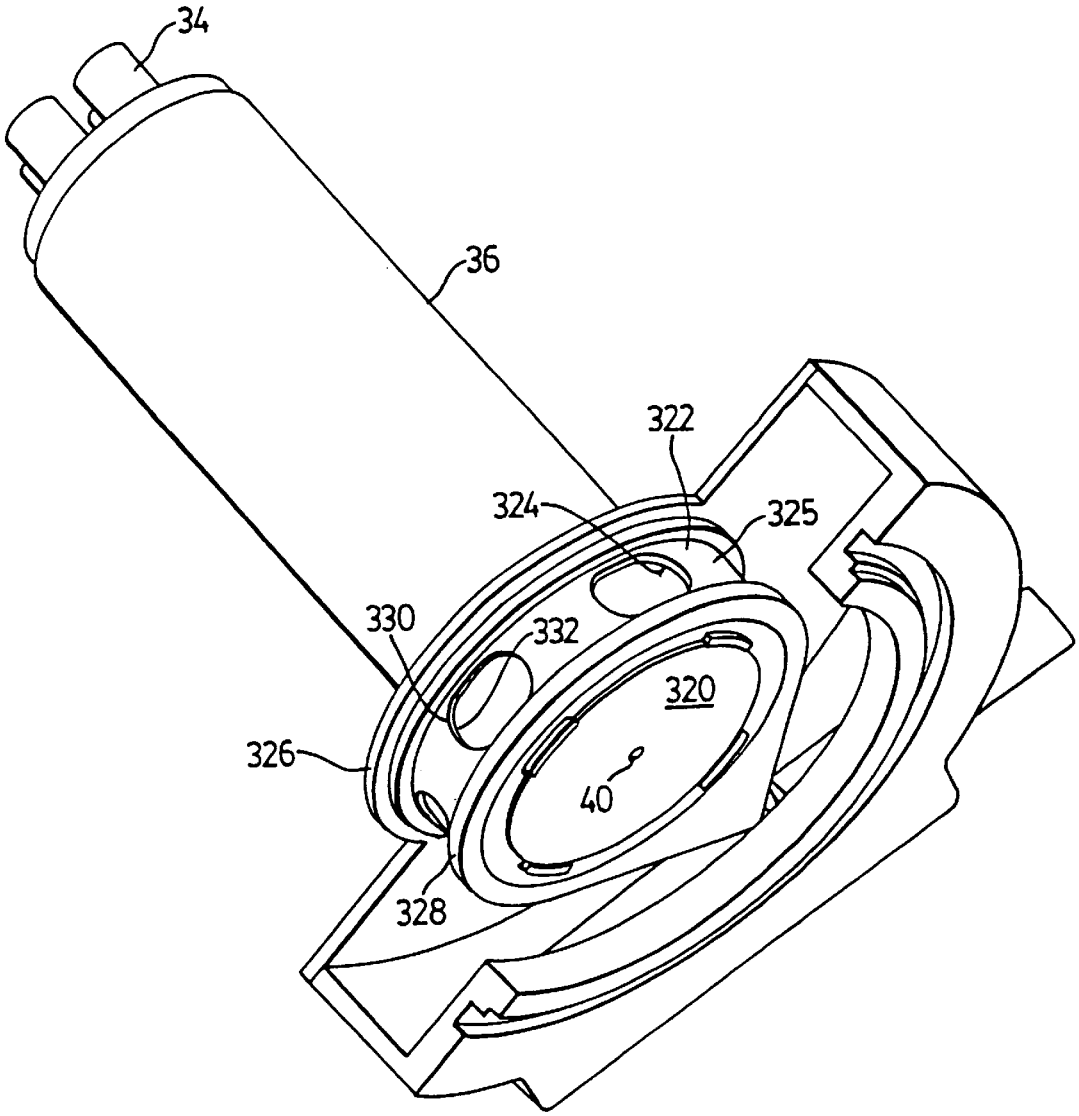
FIG. 24 is a perspective view, partly cut-away, showing an arrangement for venting a collision cell of the invention to a following vacuum chamber.

An alternative embodiment for providing radial venting of the collision cell 34 while retaining the full aperture plate used for pressurized operation is shown in FIG. 24. In the FIG. 24 embodiment, the aperture plate which provides the wall between can 36 and chamber 60 is indicated at 320, with the normal opening 40 therein. Venting is obtained by providing a pair of annular rings 322, 324 at the exit end of can 36, rotatable in a slot 325 defined by flanges 326, 328. Each ring 322, 324 contains holes or openings 330, 332, respectively. Since the rings are rotatably mounted in the slot 325, venting can be obtained by rotating the rings so that the holes 330, 332 in the pair of rings are aligned, as shown in FIG. 24. The cell may be converted to pressurized operation by rotating the rings 322, 324 so that the holes in each ring are occluded by the other ring, followed by addition of collision gas to the cell.

It will be understood that in the use of the FIG. 24 embodiment, the openings 330, 332 will always be located in the higher vacuum chamber 60, so that the collision cell is properly vented to the high vacuum chamber when desired.

While the use of a pair of rotating concentric rings provides one method of adjustably venting the collision cell 34 when desired, such venting can be achieved in other ways. For example, only the inner ring 322 with its venting holes 330 can be retained, and a sheet metal band (not shown) can be wrapped around the ring. When the band is pulled tight, it seals the holes of the inner ring, and when it is loosened the holes are opened to vent to the high vacuum chamber 60.

Other appropriate means may also be used to selectively vent the collision cell 34 to the high vacuum chamber following the collision cell, when it is desired to use the collision cell 34 as an AC-only pre-filter and not as a collision cell.

A further aspect of the invention relates to minimizing the chemical background noise. It is noted that ions within the collision cell gain an amount of kinetic energy which is proportional to the applied RF amplitude. In a typical experimental configuration, an RF amplitude of 200 volts RF provides an effective kinetic energy increment to the ions of approximately 0.3 eV. An increase in the kinetic energy of the ions may promote ion-molecule reactions which are endothermic or near endothermic or have large activation barriers or are otherwise hindered (bearing in mind that ion-molecule reactions which are endothermic, that is for which the product ions are of greater energy than the reactive ions, generally do not proceed, or proceed at low rates).

Such endothermic reactions, if they proceed, may increase the chemical (spectral) background because additional product ions are created. Therefore, maintaining the RF amplitude at a low value, e.g., less than 500 volts helps to minimize the spectral (chemical) background. Preferably the RF amplitude is maintained at between, or less than, 150 to 200 volts peak to peak (all RF voltages mentioned in this description are peak to peak).

However, it will also be seen that in some cases, there may be an advantage to adjusting the amplitude of the RF up to 500 volts or even higher. This will increase the kinetic energy of the ions and can promote reactions which are otherwise hindered, but this can be of advantage if one wishes to discriminate between two ions having the same nominal mass but which differ in thermochemistry.

For example, consider two ions for which the corresponding neutrals have ionization potentials which differ and are less than the ionization potential of a reactive collision gas. As an example of this situation, consider the ions $S^+$and $O_2^+$, for which the corresponding neutral ionization potentials are 10.4 eV (for S) and 12.063 eV (for $O_2$). Neither of these ions is normally expected to react by charge exchange with $CH_4$ (a potential reactive collision gas) which has an ionization potential of 12.6 eV, since charge transfer is endothermic. However, if the RF amplitude is increased sufficiently to provide an additional 0.6 eV to the ions, then the $O_2^+$ ion (m/z=32) reacts with the $CH_4$ molecule to convert the latter to $CH_4^+$ (m/z=16) and to form an $O_2$ molecule, which removes the interference for $S^+$ (m/z=32) since the $S^+$ reaction with $CH_4$ remains endothermic (and hence hindered). Many examples of the potential to discriminate (or distinguish) between isobaric ions by adjusting the amplitude of the RF will be envisioned.

Figure 25:
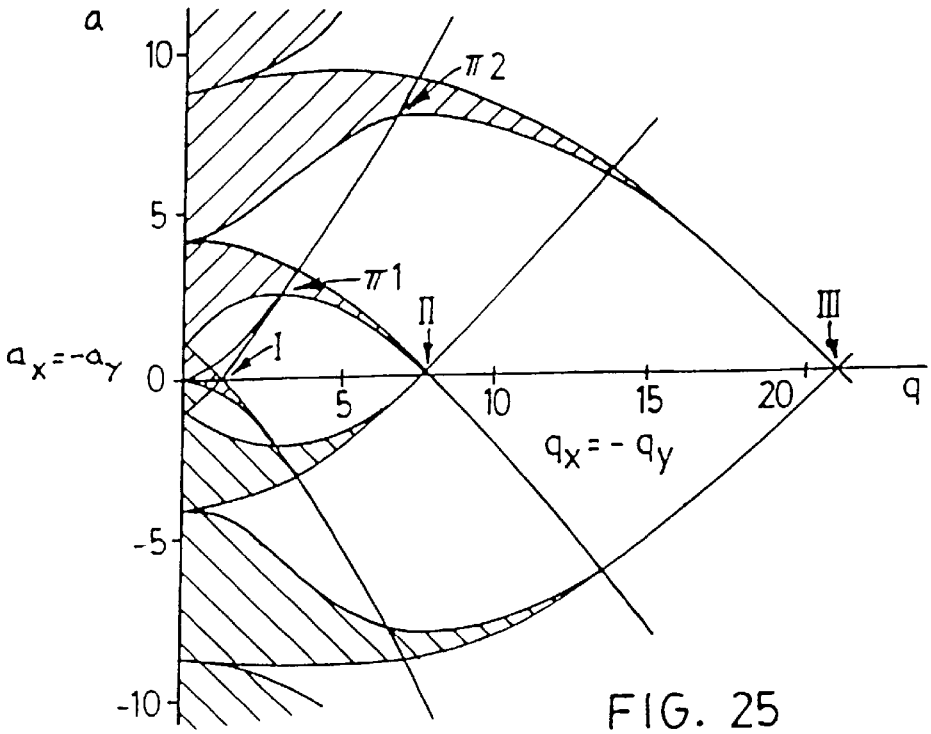
FIG. 25 shows a Mathieu stability diagram for a mass filter for different stability regions.
Figure 26:
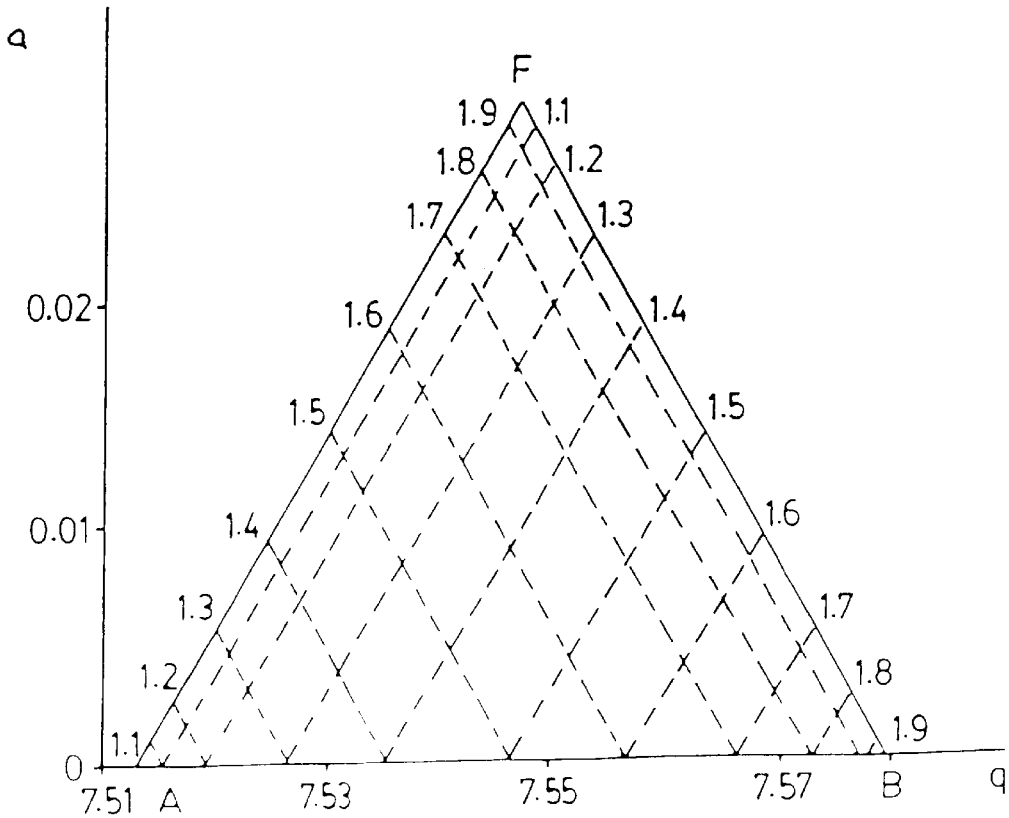
FIG. 26 shows the Mathieu stability diagram for the second stability region.

Yet another aspect of the invention relates to the operation of the collision cell 34 for alleviating problems associated with the operation of quadrupole mass analyzers in alternate stability regions. As is well-known, a quadrupole mass analyzer may be operated in a second stability region, and there are indeed an infinite number of stability regions. FIG. 25 shows the well-known Mathieu stability diagram for a quadrupole mass filter for different regions of simultaneous stability in the "x" and "y" directions. The zones I, II, III, $\pi$1 and $\pi$2 are all stability regions. Region I is the first stability region where most quadrupole mass filters are operated and is the stability region shown in FIG. 1. A more detailed view of the second stability region is shown in FIG. 26. It will be seen that the second stability region is very small, corresponding to an "a" value of between 0 and 0.03, and a "q" value of between about 7.51 and 7.58. (The broken lines in FIG. 26 are iso-$\beta$ lines and can be ignored.) As is well known, the desired stability region is chosen by appropriately setting "a" and "q" (by setting the RF and DC voltages applied and the RF frequency).

It is well known that operation in the second stability region, shown in FIG. 26, offers the opportunity of obtaining high mass resolution, but also gives rise to a problem known as "aliasing". The aliasing problem is that ions having m/z values approximately nine times greater than the m/z value being analyzed in the second stability region are also stable in the mass filter, because the "q" value of these ions corresponds to stability in the first stability region of the mass filter. The aliasing problem may be alleviated by combining a first stability region bandpass collision cell, such as cell 34, with a second region quadrupole mass filter. For example, in such an embodiment cell 34 of FIG. 1 would be operated in the first stability region and mass filter 66 of FIG. 1 would be operated in the second stability region. Operation of the bandpass collision cell 34 in the first stability region, either before or after the second region quadrupole 66, alleviates the aliasing problem because the bandpass (achieved by the application of non-zero "a" to the collision cell) may be set to reject ions above the m/z of interest. Therefore, these ions do not appear as an alias signal. This approach is viable even if the bandpass is very wide, since it is necessary only to reject ions in the collision cell which have m/z which exceed approximately nine times the m/z of interest. So long as the collision cell and second region mass filter are in series (with a detector in series with the combination with or without additional elements between them), the relative positions or sequence of the collision cell and the second region mass filter do not matter to achieve this advantage.

A second benefit, when a first stability region collision cell of the kind described is positioned before a second region quadrupole results for ICPMS from the reduction of the continuum background signal when $Ar^+$ is rejected within the collision cell. As discussed earlier in this description, $Ar^+$ may contribute to the continuum background by producing metastable ions and neutrals (i.e., ions and neutrals with one or more electrons in an excited state for a sufficient time to affect the analysis), including $Ar^{+*}$ and $Ar^*$. The $Ar^{+*}$ or $Ar^*$ may produce a background signal either directly (by impacting on the detector) or indirectly (by emitting a photon which strikes the detector). The background will be continuum if the source of the background signal is a metastable neutral (which is not affected by the mass filter). This contribution to the continuum background is more significant if the $Ar^+$ ion is accelerated, because the "appearance potential" for the metastable $Ar^*$ (i.e., the potential at which $Ar^*$ begins to appear) is of the order of 15 eV.

A second region mass filter is typically operated at ion energies of the order of 20 eV, and there is an advantage to maintaining the ion energy above this level throughout the ion optics in front of the second region mass filter. This means that the problem of $Ar^*$ metastable-induced background is more severe for a second stability mass region analyzer than for a first stability region mass analyzer. However, the continuum background signal may be attenuated by elimination of the $Ar^+$ ion in a reactive collision cell. If the $Ar^+$ ion is rejected from the cell, it cannot participate in the production of metastable neutral species. Further, metastable neutral species which were produced before elimination of $Ar^+$ are expected to be quenched by collisions with the collision gas within the cell.

There are at least two mechanisms by which the bandpass collision cell can mitigate the background signal by elimination of $Ar^+$. The first is by selection of an appropriate reactive gas which reacts with $Ar^+$ (as previously discussed). The second is that even if a collision gas is not intentionally added, the cell may be operated in a bandpass mode to reject $Ar^+$. This is effective if the bandpass does not include $Ar^+$, and hence is relevant for conditions where the mass analyzer is set to m/z values very different from that of $Ar^+$, e.g., as shown in FIG. 8. This arrangement is of significant value when the first stability region collision cell is coupled to a second stability region mass analyzer, since in that case the bandpass of the collision cell (with or without collision gas) may be operated with both a low mass and a high mass cutoff and a bandpass which includes the m/z being transmitted to the second region mass analyzer.

If the collision cell does not have a high-mass cutoff and the mass analyzer is set to a mass such that the low-mass cutoff of the collision cell is less than 40 amu (this will depend on the q of the collision cell; for example, if the collision cell q is 0.3, the low mass cutoff will be less than 40 amu when the mass analyzer is set to a mass below 0.908/0.3×40 amu=120 amu), then $Ar^+$ would be transmitted through the cell and into the optics leading to the second stability region mass analyzer (where it is most likely to be accelerated above the appearance potential for $Ar^*$ and $Ar^{+*}$) so that the continuum background will be increased. On the other hand, if the collision cell is operated with both a low mass cutoff and a high-mass cutoff, the increased continuum background resulting from the transmission of $Ar^+$ through the cell and into the optics in front of the mass analyzer will be obtained only when $Ar^+$ is within the bandpass of the collision cell. That is, the elevated continuum background would be observed only when analyzing in the vicinity of 40 amu (where the vicinity is determined by the bandpass mass window). Therefore, whereas with a conventional low-mass cutoff collision cell the continuum background is elevated over a wide range of masses (for the example given, for all masses below 120 amu), a collision cell operated with a bandpass with both low-mass and high-mass cutoffs will show this elevated continuum background only over a much more narrow analyzer mass window (since over most of the mass range, the bandpass will exclude $Ar^+$).

The same technique, with appropriate methodology, may also be used when the mass analyzer is operated in a stability region higher than the second stability region.

While the description has referred primarily to inorganic chemistry, using for example a plasma ion source, the invention is also applicable to systems used for organic analytes.

While preferred embodiments of the invention have been described, it will be appreciated that various changes may be made within the scope of the invention and within the scope of the appended claims.

We claim:

1. A method of operating a mass spectrometer system including an ion transmission device, the method comprising:

(i) providing a reactive gas in the ion transmission device, whereby the ion transmission device functions as a reactive collision cell;

(ii) supplying a stream of sample ions to the reactive collision cell including desired ions to be selected and unwanted precursor ions which may react with the reaction gas to cause the formation of ions or metastables which may result, directly or indirectly through intermediate ions, in unwanted isobaric or non-spectral interferences;

(iii) determining a range of mass-to-charge ratios of at least some of the precursor ions and intermediate ions which could result in unwanted interferences; and (iv) applying an appropriate field to the reactive collision cell to establish a bandpass within the reactive collision cell covering a continuous range of mass-to-charge ratios including that of said desired ions and excluding the determined range of mass-to-charge ratios of at least some of the precursor and intermediate ions.

2. A method as claimed in claim 1, when carried out using a multipole as the reactive collision cell.

3. A method as claimed in claim 2, when carried out using a quadrupole as the multipole for the reactive collision cell.

4. A method as claimed in claim 2 or 3, which includes applying an RF signal only to establish said bandpass within said reactive collision cell.

5. A method as claimed in claim 2 or 3, which includes applying both an RF signal and a DC signal to establish said bandpass within said reactive collision cell.

6. A method as claimed in claim 4, which includes providing the RF voltage with an amplitude of less than 500 volts peak to peak, to effect at least one of: reduction of the formation of spectral background; and loss of the desired ions due to endothermic reactions.

7. A method as claimed in claim 4, which includes providing the RF voltage with an amplitude of less than 200 volts peak to peak, to effect at least one of: reduction of the formation of spectral background; and loss of the desired ions due to endothermic reactions.

8. A method as claimed in claim 4, which includes providing the RF voltage with an amplitude in the range of 150–200 volts peak to peak, to effect at least one of: reduction of the formation of spectral background; and loss of the desired ions due to endothermic reactions.

9. A method as claimed in claim 4, which includes providing the RF applied to said multipole with an amplitude such as to add a selected energy to ions therein, and thereby discriminating between isobaric ions having different thermochemical properties with respect to said reaction gas.

10. A method as claimed in claim 2 or 3, which includes providing a broadband excitation as the means of applying said bandpass to said reactive collision cell.

11. A method as claimed in claim 2 or 3, which includes providing, as the means of applying said bandpass to said reactive collision cell, RF and DC to said reactive collision cell and rapidly scanning said RF and DC, with a notch in said RF and DC corresponding to said bandpass, to suppress secondary reaction of said intermediate ions.

12. A method as claimed in claim 1, wherein said sample ions include interfering precursor ions having the same mass as that of at least some of the selected ions, and including providing a reaction gas in said reactive collision cell to cause said interfering ions to react to form new ions of different m/z values from those of said selected ions.

13. A method as claimed in claim 1, wherein at least one of the intermediate and precursor ions have a first m/z value, and wherein the method includes operating the reactive collision cell with a low mass cutoff for the bandpass having an m/z value above said first m/z value.

14. A method as claimed in claim 1, wherein at least one of the intermediate and precursor ions have a second m/z value, and wherein the method includes operating the reactive collision cell with a high mass cutoff for the bandpass having an m/z value below said second m/z value.

15. A method as claimed in claim 1, wherein some of said intermediate and precursor ions have a first m/z value and others of said intermediate and precursor ions have a second m/z value which is higher than said first m/z value, and wherein the method includes operating the reactive collision cell with a bandpass covering a continuous range of m/z ratios between but excluding said first and second m/z values, whereby to transmit said selected ions and to reject at least some of said intermediate and precursor ions.

16. A method as claimed in claim 1, 13, 14 or 15, wherein ions from said reactive collision cell are directed into an analyzing mass spectrometer for selection, said analyzing mass spectrometer being a multipole.

17. A method as claimed in claim 1, 13, 14 or 15, wherein ions from said reactive collision cell are directed into an analyzing mass spectrometer for selection, said analyzing mass spectrometer being a time-of-flight mass spectrometer.

18. A method as claimed in claim 1, 13, 14 or 15, wherein ions from said reactive collision cell are directed into an analyzing mass spectrometer for selection, said analyzing mass spectrometer being an ion trap.

19. A method as claimed in claim 1, 13, 14 or 15, wherein ions from said reactive collision cell are directed into an analyzing mass spectrometer for selection, said analyzing mass spectrometer being a sector mass spectrometer.

20. A method as claimed in claim 1, 13, 14 or 15, and including the further steps of directing ions from said reactive collision cell into a collision cell, fragmenting ions in said collision cell to form daughter ions, and directing at least some of said daughter ions into a resolving mass analyzer for selection thereby.

21. A method as claimed in claim 1, 13, 13 or 15, and including the further steps of directing said ions to be selected from said reactive collision cell into an analyzing mass spectrometer, selecting ions in said analyzing mass spectrometer, and then directing ions selected in said analyzing mass spectrometer into a collision cell, fragmenting ions in said collision cell to form daughter ions, and directing at least some of said daughter ions into a resolving mass analyzer for selection thereby.

22. A method as claimed in claim 1, 13, 14 or 15, which includes providing the sample ions from a plasma and said reaction gas comprises gas from the plasma.

23. A method as claimed in any one of claims 13 to 15, including providing the reactive collision cell as a multipole.

24. A method as claimed in claim 1, where in the reactive collision cell includes an entrance end, through which the ions pass into the reactive collision cell, and the method comprises supplying the reaction gas into said stream of sample ions at a location in front of and spaced from said entrance end, thus to promote reactions between the reaction gas and said ions before said ions enter said reactive collision cell.

25. A method as claimed in claim 24, which includes injecting reaction gas at the entrance end of the multipole.

26. A method as claimed in claim 25, which includes injecting the reaction gas in an annular ring at said entrance end of said reactive collision cell (41).

27. A method as claimed in any one of claims 1, 13, 14 or 15, which includes providing ammonia as the reaction gas.

28. A method as claimed in any one of claims 1, 13, 14 or 15, which includes maintaining the pressure of the reaction gas in the reactive collision cell in the range 1 to 100 mTorr.

29. A method as claimed in claim 28, which includes maintaining the pressure of the reaction gas in the reactive collision cell in the range 5 to 30 mTorr.

30. A method as claimed in any one of claims 1, 13, 14 or 15, wherein the width of the bandpass is adjusted in concert with the desired ions.

31. A method as claimed in any one of claims 1, 13, 14 or 15, wherein the width and position of the bandpass is selected based on the chemistry of the selected reaction gas with the sample ions.

32. A method as claimed in any one of claims 1, 13, 14 or 15, wherein the ions supplied to said reactive collision cell are produced by an argon inductively coupled plasma.

33. A method as claimed in claim 32, wherein the method includes operating said reactive collision cell to remove $Ar^+$ ions, the reaction gas reacting with the Ar+ ions to cause removal thereof.

34. A method as claimed in claim 32, wherein the method includes operating said reactive collision cell to reject $Ar^+$ ions.

35. A method as claimed in any one of claims 1, 13, 14 or 15, which includes providing a mass filter and a detector in series with the reactive collision cell, and wherein the method includes operating said mass filter in a stability region other than the first stability region and operating said reactive collision cell in the first stability region with a high mass cutoff to reduce aliasing at said detector.

36. A method as claimed in claim 1, wherein the bandpass includes a high mass cutoff, thereby to limit the mass range of ions entering said time-of-flight mass spectrometer, whereby to improve the duty cycle of said time-of-flight mass spectrometer.

37. A method as claimed in any one of claims 1, 13, 14 or 15, wherein the reactive collision cell has an entrance end for receiving ions from a chamber having a first pressure therein and an exit for ions into a second chamber having a second pressure therein, said first pressure being greater than said second pressure, and the method including the steps of not adding reaction gas to the cell and selectively controlling the venting of said cell into said second chamber, thereby to control the pressure within the cell.

38. A method as claimed in claim 37, and including providing a vent in the vicinity of said exit end of said reactive collision cell into said second chamber and a mechanism for controlling the size of said vent, for selectively controlling venting in the vicinity of said exit end of said reactive collision cell into said second chamber, thereby to control pressure within the reactive collision cell.

39. A mass spectrometer system comprising:

(i) an ion source for producing sample ions;

(ii) a reactive collision cell having an entrance for receiving said sample ions, said sample ions including desired ions to be selected and unwanted precursor ions which may react with a reaction gas to cause the formation of ions or metastables which may result, directly or indirectly through intermediate ions, in unwanted isobaric or non-spectral interferences;

(iii) means for providing the reaction gas to said reactive collision cell; and (iv) means for applying a field to the reactive collision cell to establish a bandpass, and for adjusting the field to select a desired bandpass range, whereby in use, said desired ions are transmitted through the reactive collision cell, and at least some of said precursor and intermediate ions which may result in unwanted isobaric or non-spectral interferences, are ejected.

40. A mass spectrometer system as claimed in claim 38, characterized in that the system includes at least one conduit for supplying reaction gas for mixing with the sample ions in or before the reactive collision cell.

41. A mass spectrometer system as claimed in claim 40, characterized in that said conduit is positioned to carry said reaction gas to a location between the ion source and the entrance of the reactive collision cell, said location being spaced upstream of said entrance.

42. A mass spectrometer system as claimed in claim 40 or 41, wherein said conduit includes a conduit portion for supplying reaction gas near the entrance of, but within, the reactive collision cell.

43. A mass spectrometer system as claimed in claim 42, wherein said conduit portion is configured to provide an annular flow of the reaction gas into the entrance of the reactive collision cell.

44. A mass spectrometer system as claimed in claim 39 or 43, wherein the reaction gas supply contains ammonia as a reaction gas.

45. A mass spectrometer system as claimed in claim 39 or 43, which includes a multipole as the reactive collision cell.

46. A mass spectrometer system as claimed in claim 45, wherein the multipole comprises a quadrupole.

47. A method of operating a mass spectrometer system in which ions are transmitted through a collision cell and into an analyzing mass spectrometer, said method comprising supplying ammonia to said collision cell as a collision gas, wherein said collision cell has an entrance for receiving ions, and wherein said ammonia is injected into said entrance end.

48. A method of operating a mass spectrometer system in which a stream of ions is transmitted into a collision cell, said collision cell having an entrance end, said method comprising supplying a reactive collision gas into said stream of ions at a location in front of and spaced from said entrance end, thus to promote reactions between said reactive collision gas and said ions before said ions enter said collision cell.

49. A method according to claim 48 wherein said reactive collision gas is additionally injected into said entrance end.

50. A method according to claim 49 wherein said reactive collision gas is injected in an annular ring into said entrance end of said collision cell.

51. A method according to claim 48, 49 or 50 wherein said reactive collision gas is ammonia.

52. A method according to claim 48, 49 or 50 wherein said collision cell is operated in a bandpass mode with low and high mass cutoffs, to transmit ions between said low and high mass cutoffs.

53. A mass spectrometer system having an ion source for producing sample ions, an ion transmission device having an entrance for receiving said sample ions, a reaction gas supply, and a conduit for carrying said reaction gas from said reaction gas supply for said reaction gas to enter said ion transmission device, and means for applying excitation to said ion transmission device to set low and high mass cutoffs therein with a bandpass therebetween, wherein said conduit is positioned to carry said reaction gas to a location between said ion source and said entrance, said location being spaced upstream of said entrance.

54. Apparatus according to claim 53 wherein said conduit further includes a conduit portion for carrying said reaction gas into the entrance of said ion transmission device.

55. Apparatus according to claim 54 wherein said conduit portion is configured to provide an annular flow of said reaction gas into said entrance of said ion transmission device.

56. A mass spectrometer system having an ion source for producing sample ions, an ion transmission device having an entrance for receiving said sample ions and an exit, and an analyzing mass spectrometer for receiving ions from said exit of said ion transmission device, a reaction gas supply, and a conduit for carrying said reaction gas from said reaction gas supply to the entrance of said ion transmission device, so that ions entering said ion transmission device will pass through said reaction gas as they travel into said ion transmission device.

57. Apparatus according to claim 56 wherein said reaction gas supply contains ammonia as a reaction gas.

58. A method of operating a mass spectrometer system in which sample ions are transmitted through an ion transmission device, some of said sample ions being ions which are to be selected, others of said sample ions being precursor ions which may react in said ion transmission device to cause formation of ions or metastables which may create isobaric or non-spectral interferences with said selected ions, said method comprising operating said ion transmission device to eject at least some of said precursor ions therefrom, so as to reduce said interferences, wherein said ion transmission device has an entrance for ions from a chamber having a first pressure therein and an exit for ions into a second chamber having a second pressure therein, and including the step of selectively controlling the venting of said ion transmission device into said second chamber.

59. A mass spectrometer system having an ion source for producing sample ions, an ion transmission device having an entrance for receiving said sample ions and an exit, and an analyzing mass spectrometer for receiving ions from said exit of said ion transmission device, a reaction gas supply, and a conduit for carrying said reaction gas from said reaction gas supply to the entrance of said ion transmission device, so that ions entering said ion transmission device will pass through said reaction gas as they travel into said ion transmission device, and including a vent at said exit end of said ion transmission device, and a mechanism for controlling the size of said vent, for selecting controlling venting at said exit end of said ion transmission device.

60. A method of operating a mass spectrometer system in which sample ions are transmitted through an ion transmission device, some of said sample ions being ions which are to be selected, others of said sample ions being precursor ions which may react in said ion transmission device to cause formation of ions or metastables which may create isobaric or non-spectral interferences with said selected ions, said method comprising operating said ion transmission device to eject at least some of said precursor ions therefrom, so as to reduce said interferences, wherein RF is applied to said ion transmission device, and including the step of setting the amplitude of said RF to add a selected energy to ions therein and thereby discriminating between isobaric ions having different thermochemical properties and the step of adding a reactive collision gas to said ion transmission device, said discrimination of said isobaric ions being with respect to their different thermochemical properties with respect to said reactive collision gas.

* * * * *

UNITED STATES PATENT AND TRADEMARK OFFICE

CERTIFICATE OF CORRECTION

PATENT NO : 6,140,638

DATED : October 31, 2000

INVENTOR(S) : Scott D. Tanner; Vladimir I. Baranov

It is certified that error appears in the above-identified patent and that said Letters Patent are hereby corrected as shown below:

In Claim 21, line 1: replace "1, 13, 13 or 15" by --1, 13, 14 or 15--;

In Claim 26, at the end of the claim: delete "(41)";

In Claim 40, line 1: replace "claim 38" by --claim 39--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,140,638 
DATED : October 31, 2000
INVENTOR(S) : Scott D. Tanner and Vladimir I. Baranov It is certified that error appears in the above-identified patent and that said Letters Patent is hereby corrected as shown below:

Column 17,
Line 55, replace "providing a reactive gas" by -- providing a reaction gas --.

Signed and Sealed this

Sixth Day of July, 2004

JON W. DUDAS
*Acting Director of the United States Patent and Trademark Office*